US005787146A

United States Patent [19]

Giebeler

[11] Patent Number: 5,787,146

[45] Date of Patent: Jul. 28, 1998

[54] X-RAY IMAGING SYSTEM USING DIFFRACTIVE X-RAY OPTICS FOR HIGH DEFINITION LOW DOSAGE THREE DIMENSIONAL IMAGING OF SOFT TISSUE

[75] Inventor: Robert H. Giebeler, San Jose, Calif.

[73] Assignee: SPAD Technologies, Inc., Incline Village, Calif.

[21] Appl. No.: 733,405

[22] Filed: Oct. 18, 1996

[51] Int. Cl.[6] ..... G21K 1/06

[52] U.S. Cl. ..... 378/82; 378/84; 378/85

[58] Field of Search ..... 378/37, 82, 84, 378/85

[56] References Cited

U.S. PATENT DOCUMENTS 5,319,694 6/1994 Ingal et al. ..... 378/84
5,579,363 11/1996 Ingal et al. ..... 378/82 X
5,581,605 12/1996 Murakami et al. ..... 378/84

*Primary Examiner*—David P. Porta
*Attorney, Agent, or Firm*—Townsend & Townsend; Peter J. Dehlinger; LeeAnn Gorthey

[57] ABSTRACT

An X-ray imaging system utilizing diffractive X-ray examination is utilized which includes an interrogating X-ray path from a conventional broad band X-ray source having a standard emission point. X-rays from the X-ray source impinge on a toric monochronometer having monochromatic Bragg X-ray diffraction occurring resulting in monochromatic X-ray diffraction. X-rays exiting the slit aperture stop expand and form a scanning beam and pass through the specimen (usually soft tissue) being examined. In passing through the specimen, the X-rays receive image information by absorption, critical angle scattering, and, refraction, dependent upon the specimen, structure. The X-rays are then incident on a toric detection crystal where monochromatic Bragg X-ray diffraction again occurs leaving the image revealed by absorption, critical angle scattering, and, refraction which occurred in the specimen. The diffracted monochromatic X-rays with the specimen induced images are then directed to an X-ray detector for image processing. The preferred embodiment includes a mammography apparatus in which each mammary is swept and scanned by an oblong beam (in the order of 3×24 centimeters) with scan direction between nipple and chest. Due to beam expansion from the slit aperture stop to the toric detection crystal, mammary tissue at varied elevations from the slit aperture stop provides differing relative motion for mammary tissue at each elevation. Image processing actually segregates the soft tissue images by imaging planes taken normal to the mean path of the expanding beam. To enable construction of virtually any required diffracting surface, a technique of segmenting and bending diffracting crystals is disclosed.

7 Claims, 25 Drawing Sheets

| Degree | Actuator | | | | | |
|---|---|---|---|---|---|---|
| | Z2 | Z2 | Z3 | Z4 | Z5 | Z6 |
| alpha | | | | -1 | -1 | |
| beta | -1 | 1 | | | | |
| theta | -1 | -1 | 1 | | | |
| x | 1 | 1 | -1 | | | |
| y | 1 | 1 | -1 | | | 1 |
| z | | | | 1 | 1 | |

Fig. 6

| Step | Observed Effect | Optical Effect | Detector | Criteria | Geometrical Adjustment |
|---|---|---|---|---|---|
| | MONOCHROMATOR | | | | |
| 1 | field intensity | bragg reflection | DM2 | MAX | theta |
| 2 | source intensity | k alpha cantering | DM2 | MAX | theta Y |
| 3 | night lateral symmetry | night focal length | (DM1+DM3)/2-DM2 | MIN | XY |
| 4 | longitudinal symmetry | bragg symmetry | DM2-DM5 | MIN | alpha beta |
| 5 | left lateral symmetry | left focal length | (DM4+DM6)/2-DM5 | MIN | alpha beta |
| | ANALYZER | | | | |
| 6 | field intensity | bragg reflection | DA2 | MAX | theta |
| 7 | night lateral symmetry | night focal length | (DA1+DA3)/2-DA2 | MIN | Y |
| 8 | longitudinal symmetry | bragg symmetry | DA2-DA5 | MIN | alpha beta |
| 9 | left lateral symmetry | left focal length | (DA4+DA6)/2-DA5 | MIN | alpha beta |

Fig. 20

X-RAY IMAGING SYSTEM USING DIFFRACTIVE X-RAY OPTICS FOR HIGH DEFINITION LOW DOSAGE THREE DIMENSIONAL IMAGING OF SOFT TISSUE

This invention relates to an improvement in U.S. Pat. No. 5,319,694 to Incral et al. for METHOD FOR OBTAINING THE IMAGE OF THE INTERNAL STRUCTURE OF AN OBJECT, issued Jun. 7, 1994. Specifically, a diffraction system and preferred beam path is set forth which utilizes a substantial solid angle of energy from a conventional X-ray point source to enable this technique to be practically applied. An X-ray imaging system using diffractive X-ray optics allows low dose, high definition, three dimensional imaging, ideal for Mammography.

BACKGROUND OF THE INVENTION

The state of the art in medical imaging has provided modalities such as enhanced ultrasound, nuclear magnetic resonance, light scattering/absorption, and nuclear to complement X ray imaging. In addition, X ray imaging has been improved by energy optimization with filters and targets, Compton scatter control, and more sensitive higher resolution photoluminescent screen film combinations. More recently, digital data acquisition and computer enhancement is being considered to segregate relevant data from non-relevant (noise), and perform computer assisted interpretations.

None of these developments offer the desired complement of performance and cost. The elimination of radiation dose known to cause cancer by MRI or ultrasound techniques is a notable benefit, but the desired soft tissue definition and resolution has not been obtained. Such definition and resolution would allow, for example, the identification of microtumors less than one millimeter in diameter associated with incipient malignancy.

In addition, the high cost, the learning curve in image interpretation, and the inability to accommodate real time invasive procedures has limited the growth of many of these new technologies in spite of superior soft tissue definition as compared to X ray.

The Mammography application is exceptionally demanding in that extremely good resolution and soft tissue differentiation is necessary to identify the early stages of cancer, i.e. microcalcifications or microtumors. The "radiologically dense breast" further complicates this objective with a high degree of Compton scatter occurring, requiring a variety of scatter control measures. Many patents address solutions to these problems in energy optimization with filters and targets, slot scanning to reduce Compton scatter, grid design to reduce scatter, and voltage and current control algorithms to control exposure with varying thickness.

Digital mammography may be of great potential in extracting relevant data in assessing cancer, but the non-obvious scientific basis, in combination with the perceived possibility of increasing an already high false positive cancerous detection rate has made its acceptance slow. In addition, evidence suggests that excessive radiation dose in Mammography remains a cancer risk.

The overall Breast care application requires initial large volume low risk screening, real time imaging for needle biopsy assist, and three dimensional imaging for treatment planning. Many patents address these applications including system design, clinician/patient ergonomics, field size collimation, stereoscopic real time imaging embodiments, and three dimensional imaging.

The evolution of digital imaging technology, particularly for mammography has resulted in patents on detectors in conjunction with methods such as slot scanning.

The use of diffractive X-ray optics in imaging has been limited primarily to the use of synchrotron radiation, but some work has been done applying diffractive optics with electron target approaches. None of these approaches have been satisfactory concepts for mammography.

In U.S. Pat. No. 5,319,694 to Ingal et al. for METHOD FOR OBTAINING THE IMAGE OF THE INTERNAL STRUCTURE OF AN OBJECT issued Jun. 7, 1994, the approach described by Ingal et al. can image only a small area with a lengthy exposure time, inappropriate for mammography. However, it is the purpose of this disclosure to utilize the technique of Ingal et al. in a practical embodiment for soft tissue imaging, such as that required in mammography.

DEFINITION OF TERMS

In the following description of a diffractive X-ray technique, it will be necessary to describe toric diffraction surfaces and the X-ray beams generated by reflection from crystals. So that a clear set of definitions can be presented, the following definitions are offered.

Toric axis $A_T$—the axis about which the closed curve is rotated to generate a torus. In the following disclosure, the X-ray source is located on this axis.

Toric radius $R_T$—the distance to the axis about which the closed curve (usually a circle) is rotated to generate a toroid.

Diffraction radius $R_1$—a toric radius defining the toric surface from which diffraction occurs.

Crystal matrix radius $R_2$—a toric radius defining the toric surface from which crystal alignment occurs.

Monochromatic X-ray—a monoenergetic X-ray usually created by Bragg diffraction from an asymmetrical crystal surface where the diffracting surface is usually in one (toric) plane and the surface from which crystal alignment occurs is usually in a second and different toric plane.

Line conjugate—a line or slit through which all X-rays pass usually as the result of a toric diffraction surface diffracting the X-rays from a point source.

SUMMARY OF THE INVENTION

An X-ray imaging system utilizing diffractive X-ray examination is utilized which includes an interrogating X-ray path from a conventional broad band X-ray source having a standard emission point. X-rays from the X-ray source impinge on a toric monochronometer having monochromatic Bragg X-ray diffraction occurring resulting in monochromatic X-ray diffraction. The toric monochronometer is preferably provided with a diffraction radius and crystal matrix radius providing asymmetric diffraction. In the asymmetric diffraction the point source is relatively distant and the diffracted monochromatic X-ray is focused to and incident on a line conjugate within a slit aperture stop for radiation confinement of all but the diffracted monochromatic X-rays.

X-rays exiting the slit aperture stop expand and form a scanning beam and pass through the specimen (usually soft tissue) being examined. In passing through the specimen,. the X-rays receive image information by absorption, critical angle scattering, and, refraction, dependent upon the specimen structure. The X-rays are then incident on a toric detection crystal where monochromatic Bragg X-ray diffraction again occurs leaving the image revealed by absorption, and the rejection of critical angle scattering, and, refraction which occurred in the specimen at the analyzer crystal array. The diffracted monochromatic X-rays with the specimen induced images are then directed to an X-ray detector for image processing.

The preferred embodiment includes a mammography apparatus in which each mammary is swept and scanned linearly or rotationally by an oblong beam (in the order of 3×24 centimeters) with scan direction between nipple and chest. Due to beam expansion from the slit aperture stop to the toric detection crystal, mammary tissue at varied elevations from the slit aperture stop provides differing relative motion for mammary tissue at each elevation. This enables apparent differential velocities of observed image features to be segregated by apparent scan velocity utilizing factor analysis and singular value decomposition. Image processing actually segregates the soft-tissue images by imaging planes taken normal to the mean path of the expanding beam.

To enable construction of virtually any required diffracting surface, a technique of segmenting and bending diffracting crystals is disclosed. First, crystal segments and segment holders are generated with toric boundaries about the X-ray source. Thereafter, a crystal segment holder is machined with diffraction radius $R_1$. The crystal segment is machined on the back or holder addressed surface with the convex surface having crystal matrix radius $R_2$. This convex surface of the crystal segment is then bonded to the holder. Finally, the finished surface of the crystal in the holder is then machined with diffraction radius $R_1$.

When an entire segmented diffracting surface is constructed of diffracting segments fastened in this manner, the segment diffracting surface enables X-ray energy to be gathered from a conventional X-ray source over a relatively large solid angle. The segmented surface causes diffraction from that source with directionality required for the particular imaging task at hand. Here that technique is used with the toric X-ray monochronometer and toric detection crystal in the preferred mammography embodiment.

OBJECTS AND ADVANTAGES

U.S. Pat. No. 5,319,694 to Ingal et al. for METHOD FOR OBTAINING THE IMAGE OF THE INTERNAL STRUCTURE OF AN OBJECT clearly shows the potential advantages of imaging by virtue of mechanisms supplemental to absorption, i.e. refraction and critical angle scattering in small animals.

This disclosure expands on the prior art primarily in the invention of an X-ray optics scheme to allow a large area to be imaged with a higher intensity while still using a conventional X-ray electron target rotating an anode X-ray source. This is accomplished with arrays of Johansson toroidally curved monochromator crystals for both the analyzer and monochromator in a mirroring configuration as shown in FIGS. 1 and 2.

An additional benefit over U.S. Pat. No. 5,319,694 to Ingal et al. for METHOD FOR OBTAINING THE IMAGE OF THE INTERNAL STRUCTURE OF AN OBJECT is the reduction of monochromators before the patient from two to one, and the further reduction of scattered stray radiation from the crystal from irradiating the patient. The monochromatic nature of the beam impinging on the patient reduces patient surface dose by up to a factor of ten.

Another additional benefit is the reduction in required dose by using a reflection analyzer monochromator where the beam is not split into two parts. This reduces the dose to the patient by a factor of two. The data enhancement associated with the two beams is achieved herein by digitally integrating over specified parts of the analyzer rocking curve, and digital subtraction.

An additional benefit is the elimination of any Bucky scatter grid, which reduces the patient exposure by an additional factor of three.

An additional benefit to this configuration with a diverging/converging beam is the ability to magnify the image of the object.

An additional benefit with a digital cooled CCD tiled array detector is a reduction in patient exposure by up to an additional factor of five.

An additional benefit with the CCD digital detector is the ability with boundary intensity detectors to extend the linear dynamic range of detection, to minimize patient exposure, and obtain good imaging of all parts of the breast, including skin line.

An additional benefit of this invention with a diverging/converging beam envelope and effective line source is the ability to do three dimensional imaging by virtue of the differential velocity, where the high aspect ratio beam envelope is linearly scanned in one dimension. The deconvolution process not only offers 3D imaging, but image enhancement in the volume of interest.

An additional benefit is the reduction in the need for breast compression, by virtue of lower inherent surface dose, elimination of Compton scatter image degradation, increased dynamic range of detection, and ability to deconvolute overlaying image features (three dim imaging).

Another benefit of this invention is that is capable of either digital or film detection. A unique mechanical embodiment to provide these capabilities is presented. A unique operational systems description is presented.

BRIEF DESCRIPTION OF THE DRAWINGS

FIG. 6 is a table illustrating actuation of micropositioners set forth in FIG. 5;

FIG. 10 illustrates the well known Johansson Curvature illustrating how the combination of crystal structure curvature and diffracting surface curvature act together to provide diffraction from a crystal surface;

FIG. 20 is a table explaining sequence of operation of the apparatus of FIG. 20;

DESCRIPTION OF THE PREFERRED EMBODIMENT

Figure 1:
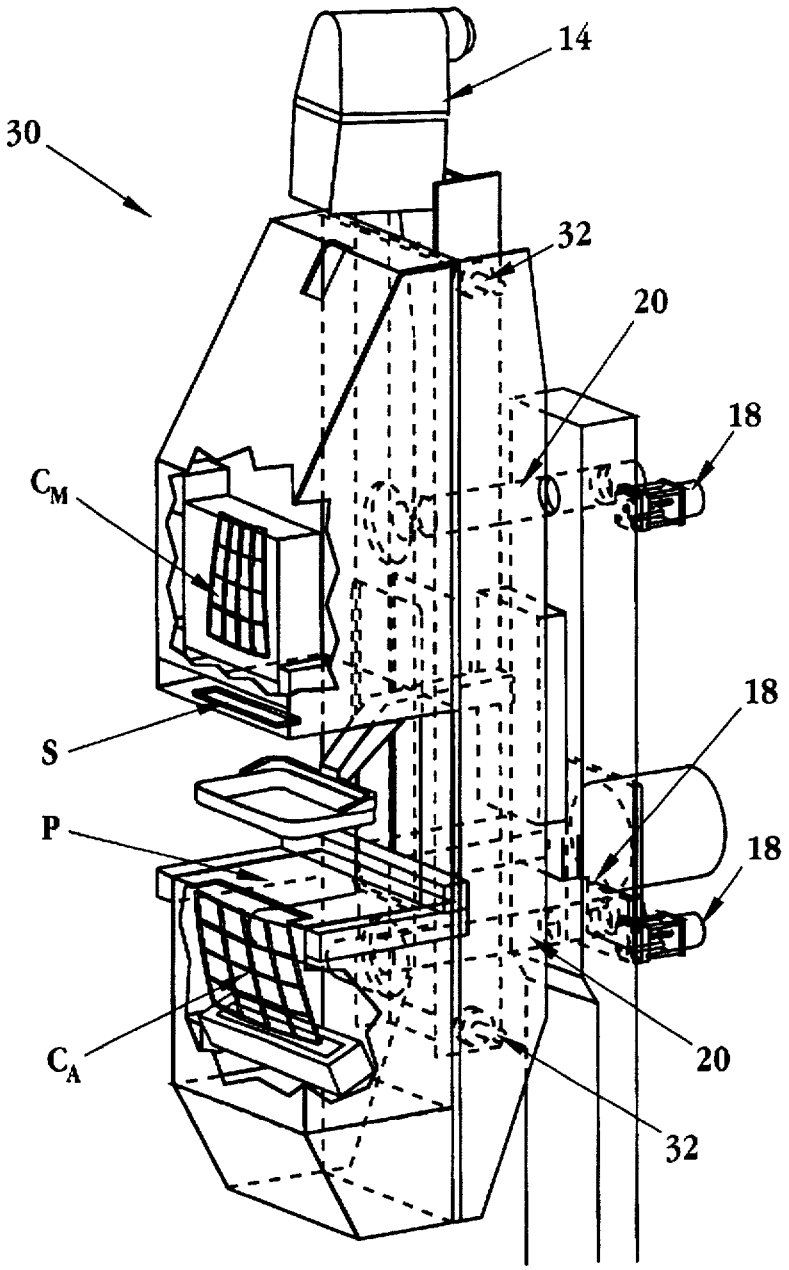
FIG. 1 is a perspective view of a mammography apparatus constructed utilizing the diffraction X-ray technique of this invention.
Figure 2:
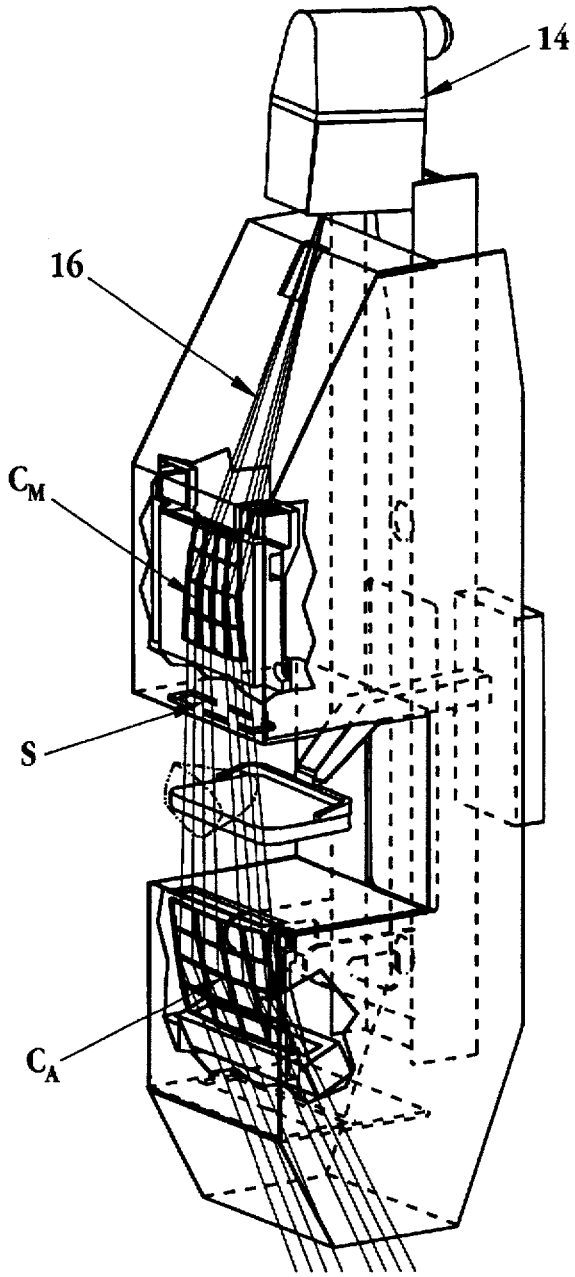
FIG. 2 is the apparatus of FIG. 1 illustrating an X-ray ray trace with the toric radius $R_T$.

FIG. 1 and 2 shows the preferred embodiment of the invention of the X-ray diffraction system. Conventional rotating anode X-ray tube 14 generates X-rays using a target material of choice, either copper, moly, silver, rhodium, or tungsten. The objective is to utilize the k alpha emission line of interest, depending on the thickness of the patient. The thicker the patient, the higher the energy necessary to minimize surface dose, and maximize detectability. For Mammography, 17 to 20 KeV is best. Unlike conventional mammography, the tube voltage is driven about 4 times the k alpha line, or 66 KV, to achieve the best efficiency in exciting the k alpha line. Regulation of high voltage is required to 0.01% because of the high sensitivity to k alpha line intensity.

Radiation 16 from X-ray tube 14 has a solid angle in the order +−2.5 degrees in one plane and +−6 degrees in the other plane falls on the crystal monochromator array $C_M$. The radiation at the Bragg angle corresponding to the X-ray energy of interest is Brag reflected and refocuses to a line and passes through slit aperture stop S. This slit aperture stop S shields all other scatter radiation from the patient.

The beam then again expands to a 3 cm by 24 cm field at breast platform P. This field is scanned either continuously or in steps to cover a 18 cm by 24 cm field size.

The beam after passing through the patient falls on analyzer crystal array $C_A$, is Bragg reflected from this array and then falls on tiled array ccd detector D.

Figure 3:
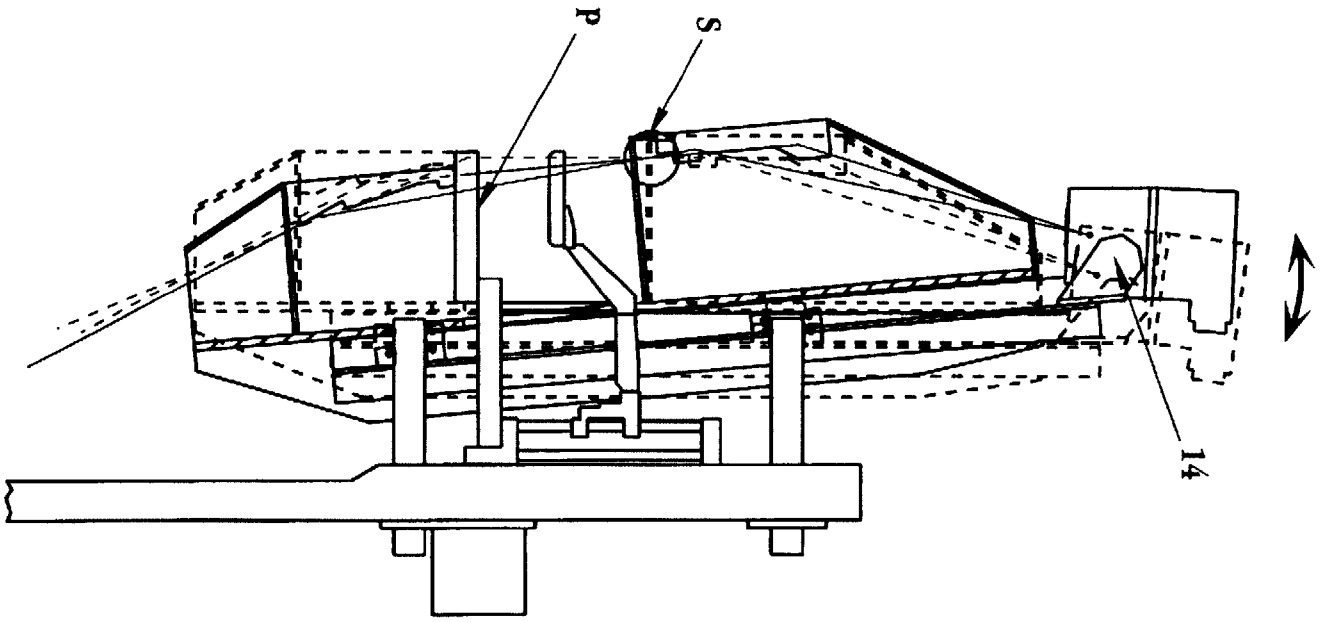
FIG. 3 is the apparatus of FIG. 1 illustrating an X-ray ray trace in side elevation section illustrating rotational scan.

Scanning mechanism M is comprised of three ball screws/motors 18, and two guide cylinders 20 and accompanying roller bearings. Independent control of these stepper motors allows either a linear scan or a rotational scan about the slit center to be accomplished. A rotational scan enables one to either do time delay integration in a continuous scan mode, or stitching image slices together in a step scan mode without geometric aberrations, as shown in FIG. 3.

Figure 4:
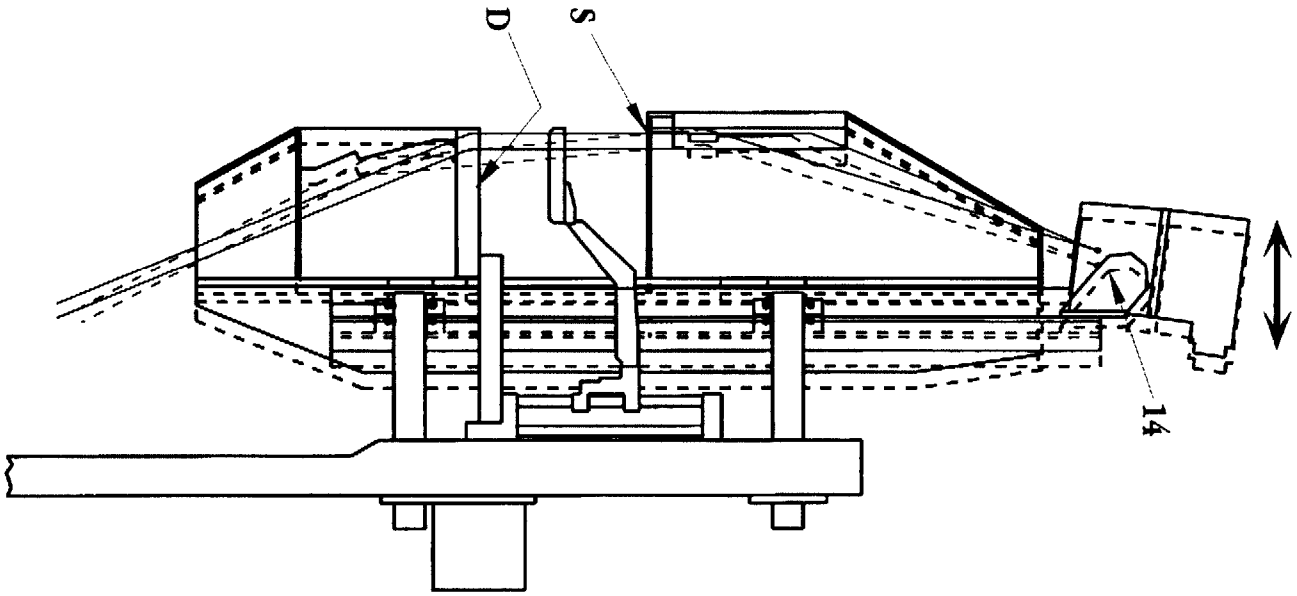
FIG. 4 is the apparatus of FIG. 1 illustrating an X-ray ray trace showing linear scanning of the beam.

A linear scan allows for deconvolution of three dimensional data by virtue of differential velocity, as shown in FIG. 4. The unique line source typical of this diffraction system is ideal for this approach to three dimensional imaging.

Figure 5:
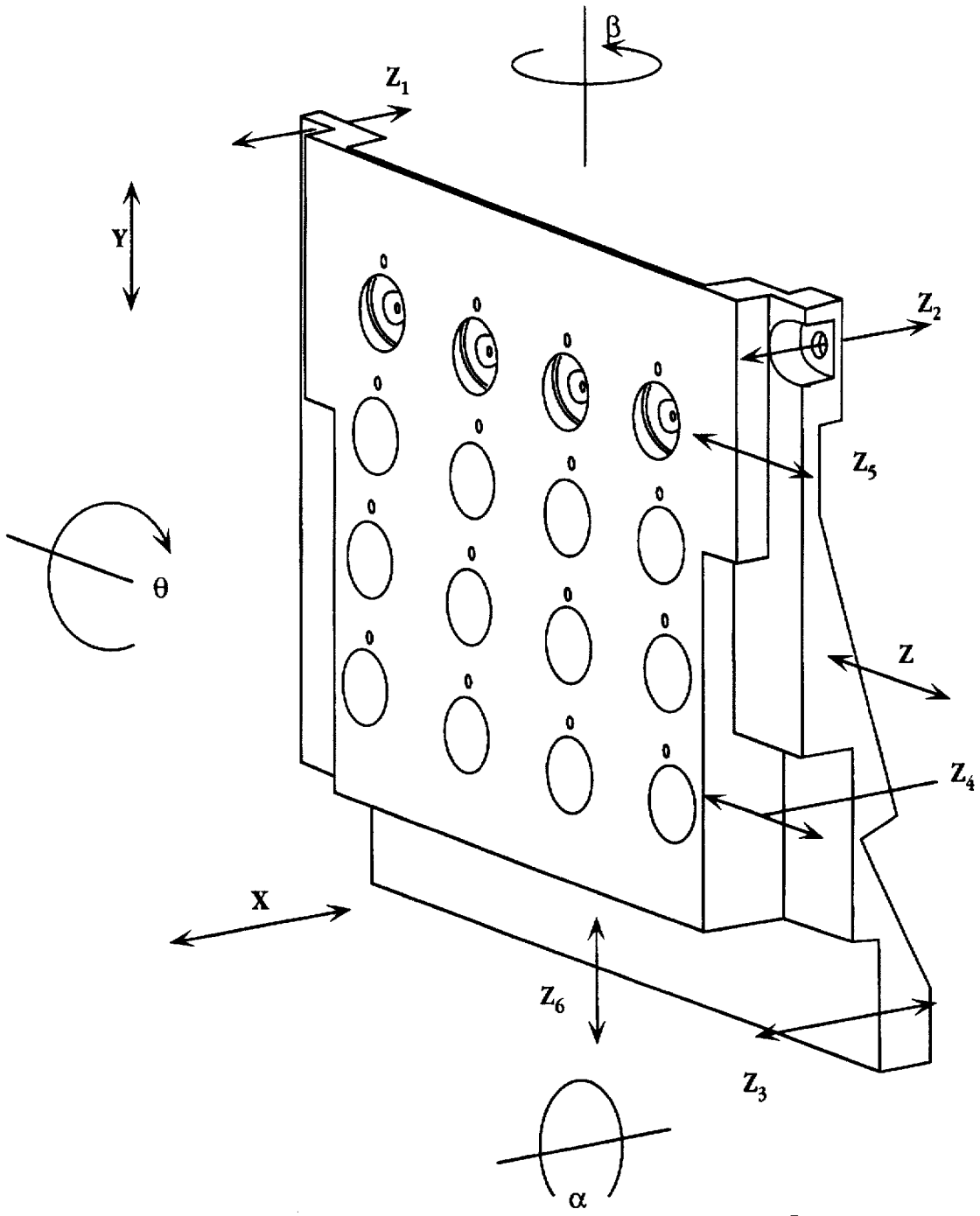
FIG. 5 illustrates a perspective view of piezoelectric micropositioners for adjusting one of the crystal arrays.

The crystal array platforms are optically aligned by six piezoelectric micropositioners $Z_1$–$Z_6$ on each platform, as shown in FIG. 5. The six degrees of freedom are provided in accordance with the vectors adjacent each of the micropositioners $Z_1$–$Z_6$ This much is shown in conjunction with the table of FIG. 6.

Referring to the table of FIG. 6, movement of the crystal can be seen to include X, Y, Z, A, B, and e (that is Alpha, Beta and Theta). Where a positive value appears, piezomicropositioners increase in dimension; where a negative value appears, piezomicropositioners decrease in dimension.

TABLE I

FIG. 8

Monochronometer

Parameters

R1 = 1,000000
R2 = 2,000000
$R_T$ = 40,000000
$R_T$ = 40,000000
A = 68,000000
B = 73,000000
C = 2,500000
G = 0,020000

R1 Angles

D = 79,000000
E = 79,000000
F = 79,000000
H = 79,003091
I = 79,004261
J = 79,002345

R1 Differences

D-D2 = 0,000000
E-E2 = 0,000004
F-F2 = 0,000003
H-H2 = 0,000014
I-I2 = 0,000034
J-J2 = 0.000012

TABLE I-continued

Figure 8:
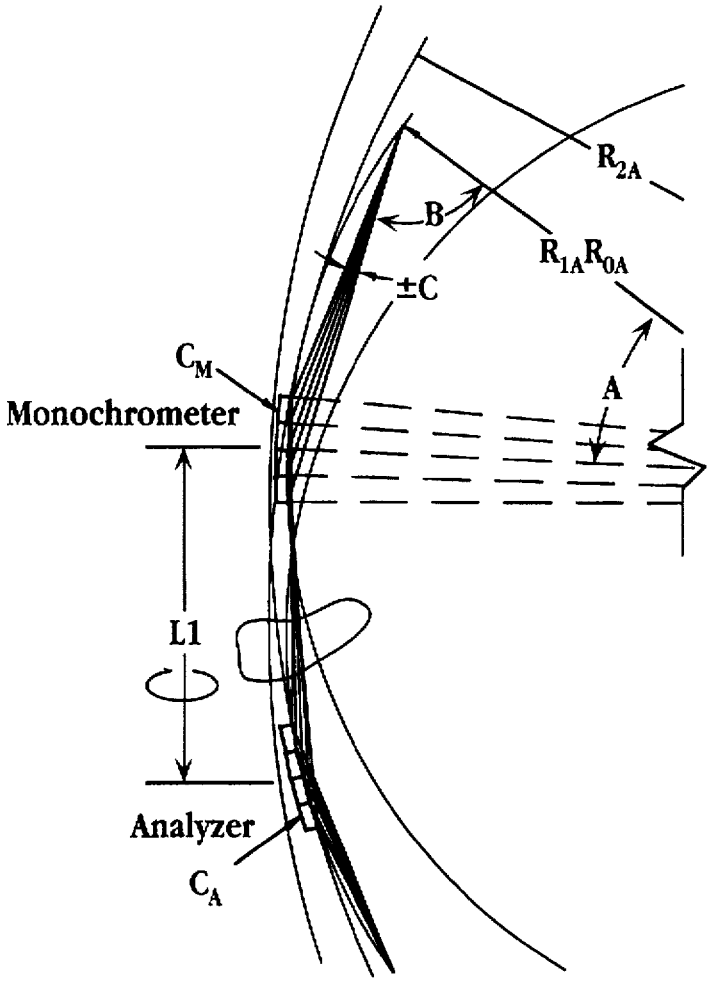
FIG. 8 is the diffraction path of the apparatus of FIG. 1 with only the diffracting and segmented crystals being shown.

| FIG. 8 |
|---|
| R0 Angles |
| D = 79,002343 |
| E = 79,002770 |
| F = 79,002023 |
| H = 79,005434 |
| I = 79,007031 |
| J = 79,004368 |
| R0 Differences |
| D-D2 = 0,001269 |
| E-E2 = 0.000316 |
| F-F2 = 0.001647 |
| H-H2 = 0.001285 |
| I-12 = 0.000354 |
| J-J2 = 0.001632 |
| ANALYZER |
| Parameters |
| R1 = 1,000000 |
| R2 = 2,000000 |
| $R_T$ = 40,000000 |
| $R_T$ = 40,000000 |
| A2 = 68,000000 |
| B2 = 79,000000 |
| X = 0,000000 |
| L1 = 0,555930 |
| R1 Angles |
| D2 = 79,000000 |
| E2 = 79,000004 |
| F2 = 78,999997 |
| H2 = 79,003076 |
| I2 = 79,004227 |
| J2 = 79,002357 |
| R0 Angeles |
| D2 = 79,001074 |
| E2 = 79,002454 |
| F2 = 79,000376 |
| H2 = 79,004149 |
| I2 = 79,006677 |
| J2 = 79,002736 |

Figure 7:
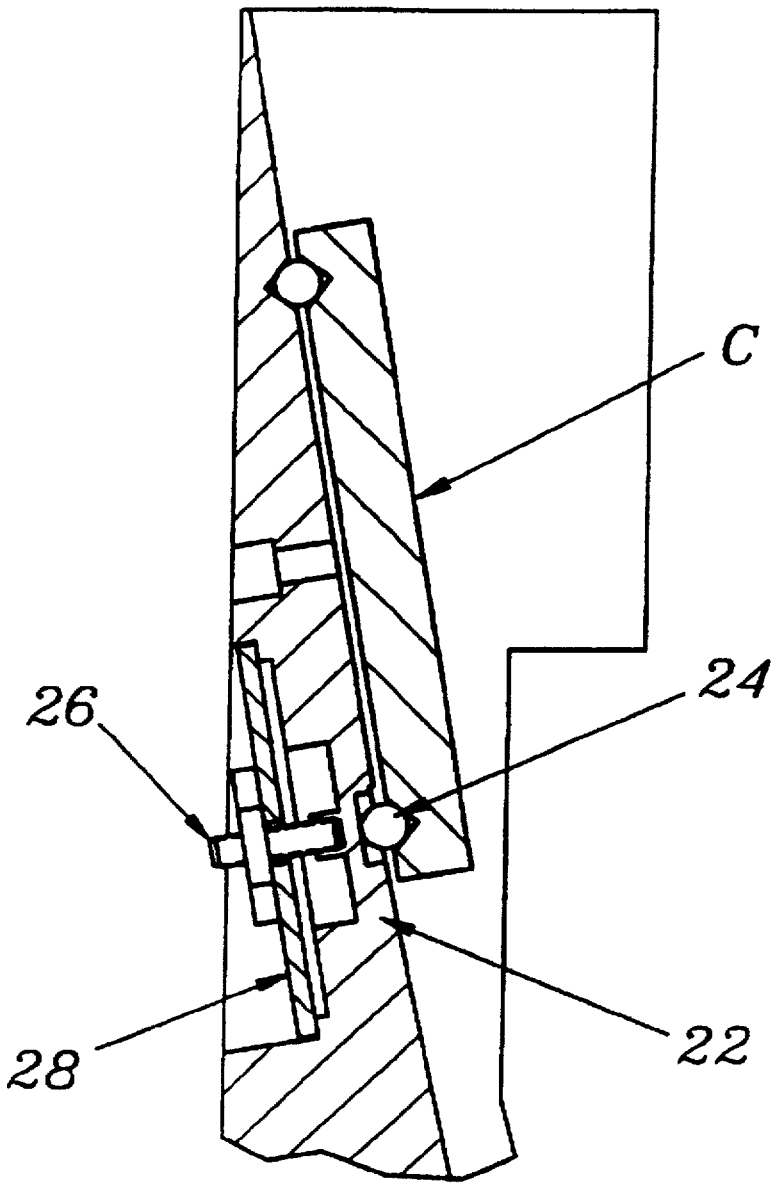
FIG. 7 illustrates in side elevation a crystal.

The Bragg angle of each individual crystal is fine tuned by applying a load to flexible diaphragm 22 under third ball support 24 of the mount of crystal C as shown in FIG. 7. This load is generated with screw 26 and larger flexible diaphragm 28 to decrease the sensitivity of the adjustment.

As shown in FIG. 2, diffraction cage 30 supports the array platform in a rigid manner by virtue of its rigid structural design both in torsion and bending, and is vibration isolated from the machine by six sets of air bearing supports 32. These air bearings provide isolation with a minimum of displacement so that the relationship to the X-ray tube and patient is preserved.

Figure 13B:
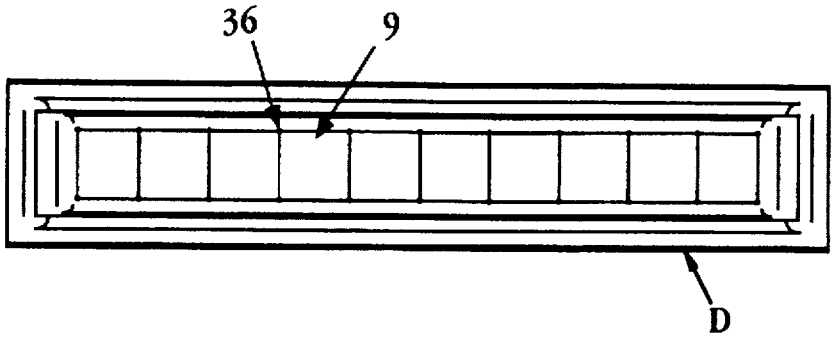
FIG. 13A and 13B illustrate respectively a side elevation section and plan view of a detector useful with this invention.
Figure 13A:
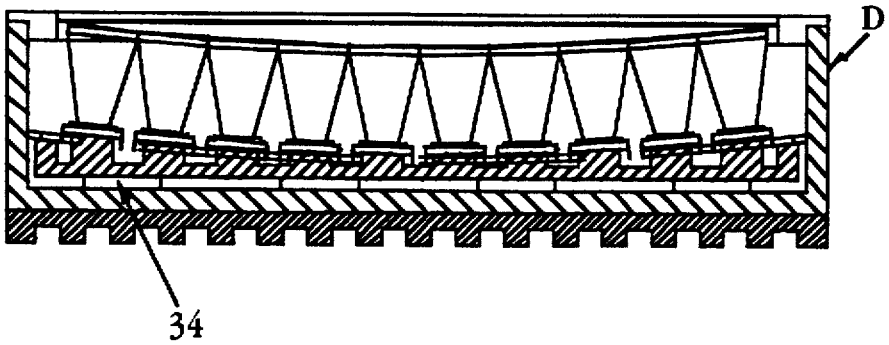

Referring to FIG. 13A and 13B, tiled array ccd detector D is a tiled array of eight 512 by 512 CCD units, covering a 3 cm by 24 cm field, all cooled to −20 degrees C with Peltier modules 34 for minimum noise. Conventional heat sinks and tapered fiber optics are shown in FIGS. 14A and 14B, but will not be further discussed here.

Segmenting the detector in this manner allows a variety of problems to be solved. First, it will be observed that the detector can be curved according to the distance from the source to minimize geometric aberrations in image reconstruction. In addition, each unit can have a separate driver and converter to maximize the data rate transfer (30 megabits in 3 seconds). Separate real time x-ray photodiode detector elements 36 are located in all quadrants between the CCDs in the array to allow CCD integration time to be established prior to full exposure.

Tiled array ccd detector D can be replaced with a film cartridge as an alternative. The film must be driven at a rate that corresponds the velocity of the image as the scan is executed only a rotational scan without geometric aberration is done.

In-depth Description of X-ray Optics

Figure 9:
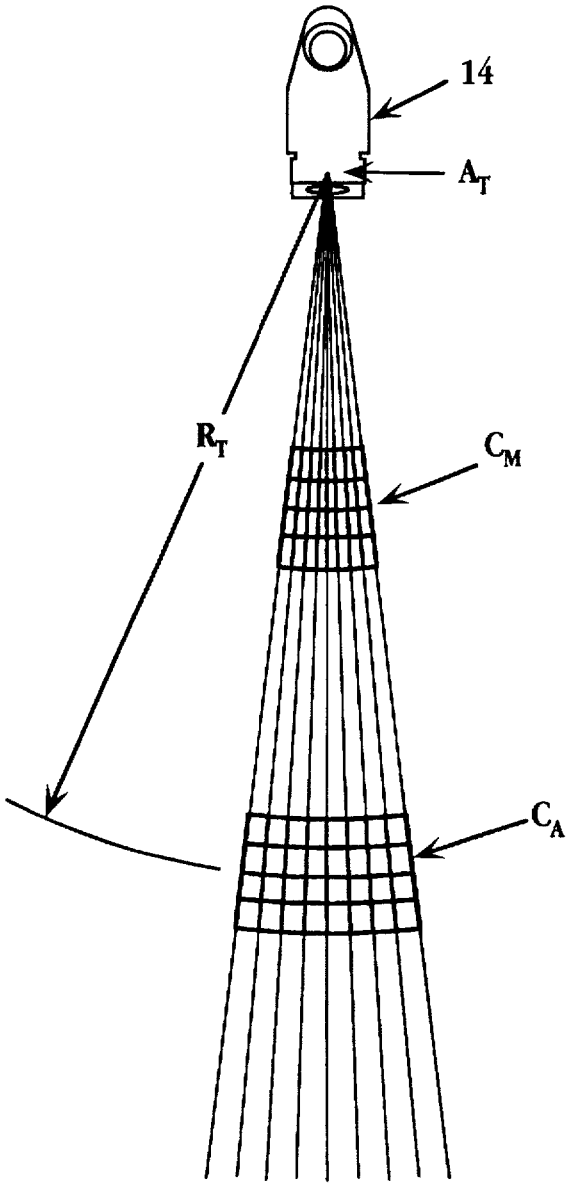
FIG. 9 is a plan view from the conventional point X-ray source past the two segmented diffracting surfaces utilized with this invention, it being remembered that the traced diffracting path is not in the plane of the view.

FIG. 8 and 9 show the detail diffraction path ray trace for this system. The objective met by the design is the utilization of as much of the emitted X-ray energy from the source at the wavelength of interest as possible. This objective is met by both a large cone of emitted X-rays being utilized (low F number concept in optics) as well as by utilization of the emission from the entire surface of the finite size source target area.

The beam angle and source size is simulated in this ray trace. Electrons $e^-$ are hitting an X-ray generating source such as a rotating annode target. The medial portion of the source lies on the Roland circle (diffraction radius $R_1$). (See also FIG. 8). Prior art in X-ray tube design provides for angular projection target T where the projected beam is a small symmetrical spot, even if electron beam E hitting the target is long and narrow. This is done to distribute the heat load of the electron beam. In utilizing such a source in this design, the target is oriented as show to minimize aberrations in meeting the above criteria.

Figure 10:
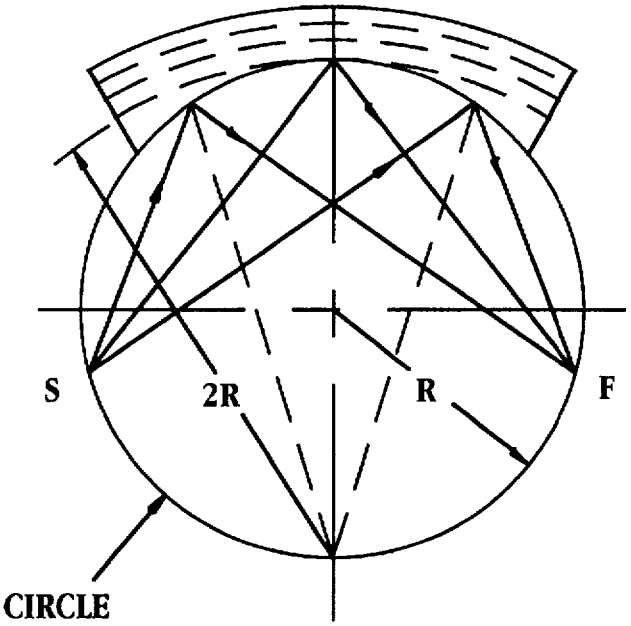
FIG. 10 is a prior art detail of the X-ray source illustrating the principle that the X-ray source must lie on the Roland circle of the monochronometer crystal and further illustrating that for practical purposes the X-ray source is not a point source but does have specific dimension.

The basic prior art diffraction principal of this focusing diffraction monochromator design is the Johansson geometry as shown in FIG. 10, where the curvature of the crystal structure is twice the curvature of the physical surface of the crystal. This Rowland geometry provides perfect theoretical focusing for an infinitely small source, and a large angular cone of emitted rays. The described crystal arrays are in fact emulating the pure Johannson geometry, and are arrays only for the purpose of ease of manufacture. Each successive row in each array has an increasing asymmetry in crystal plane orientation in order to emulate a larger single crystal Johannson monochromator. As can be seen, diffraction radius $R_1$ and crystal matrix radius $R_2$ appear to enable source 40 to focus from all points on the surface to focal point 42.

The disclosed mirroring diffraction system shown in FIG. 8 includes two Johansson type arrays where the output of crystal monochromator array $C_M$ is the input to analyzer crystal array $C_A$. Ideally all rays Bragg reflect through both crystal monochromator array $C_M$ and analyzer crystal array $C_A$, but can only do so if the diffraction ray trace shows that the Bragg angle is identical on both crystals, or at least within a small percentage of the characteristic rocking curve for the crystal material in use.

The disclosed mirroring diffraction system achieves a very high throughput of rays (identical Bragg angle on both crystals) emitted over the entire surface of the 0.1 mm projected source size, equivalent to the bandpass for the entire K alpha line and for as large a beam cone as geometrically possible for a given Bragg angle. This is accomplished by selecting the best relative orientation of the two crystal arrays, the best ratio of Rowland circle diameter for the two arrays, and the best asymmetry for the two crystal arrays, i.e. the best combination of the above variables. The behavior the system becomes dispersive, whereas a single Johansson crystal monochromator is otherwise considered non-dispersive, i.e. only perfect focusing for an infinitely small source size.

TABLE I

FIG. 8

Monochronometer

Parameters

R1 = 1,000000
R2 = 2,000000
R3 = 40,000000
R4 = 40,000000
A = 68,000000
B = 76,000000
C = 2,500000
G = 0,004000

R1 Angles

D = 79,000000
E = 79,000000
F = 79,000000
H = 79,003091
I = 79,004261
J = 79,002345

R1 Differences

D-D2 = 0,000000
E-E2 = 0,000004
F-F2 = 0,000003
H-H2 = 0,000014
I-I2 = 0,000034
J-J2 = 0.000012

R0 Angles

D = 79,002343
E = 79,002770
F = 79,002023
H = 79,005434
I = 79,007031
J = 79,004368

R0 Differences

D-D2 = 0,000772
E-E2 = 0.000537
F-F2 = 0.001242
H-H2 = 0.000781
I-12 = 0.000537
J-J2 = 0.001243

ANALYZER

Parameters

R1 = 1,000000
R2 = 2,000000
R3 = 40,000000
R4 = 40,000000
A2 = 68,000000
B2 = 79,000000
X = 0,000000
L1 = 0,555930

R1 Angles

D2 = 79,000000
E2 = 79,000004
F2 = 78,999997
H2 = 79,003076
I2 = 79,004227
J2 = 79,002357

R0 Angeles

D2 = 79,001074
E2 = 79,002454
F2 = 79,000376
H2 = 79,004149
I2 = 79,006677
J2 = 79,002736

Referring exclusively to Table I, R1 through R4 for each monochromator define the toroidal curvature of both the crystal structure (bending) and the physical surface (machining). Angle A controls the Bragg angle, or energy, angle B controls the symmetry of the monochromator, and C is the width of the beam cone in plane. Angle G defines the divergence of the beam out of the plane, L1 is the distance between the monochromators, and X1 is the angle of rotation between the monochromators.

Angles D through J are the Bragg angles of the six rays defining the beam cone, with D being the central ray.

The finite source size is simulated by R0, where R1–R0 is the source size.

It can be seen that by virtue of "R0 angles" that the finite source size results in a change in angle of 0.002 to 0.003 degrees, an acceptable percentage of the 0.012 K alpha line width.

It can also be seen that the Bragg angle differences between the two monochromators are acceptable as compared to the narrowest rocking curve of lithium flouride of 0.028 degree. The "R1 differences" are less that 20 millions, as expected, and the "R0 differences" associated with the finite source size are less than 0.001°, comparable to the rocking curve, and a small fraction of the associated shift in overall Bragg angle of 0.002 degrees. The previously mentioned orientation of the source results in the effective projected size of the source being smaller for the F ray, which equalizes the R0 differences.

In the case of silicon monochronometers, with a narrow rocking curve (ie. 0.0004°) the $R_0$ differences can be further reduced by optimizing the above stated optical parameters for each row of crystals in the array separately. In this manner $R_0$ differences can be less than 0.0002°.

In plan as shown in FIG. 9, the beam cone angle is +–6 degrees and all ray traces through this plain are identical and without aberration, as the crystals in the array are sector shaped and have a toroidal curvature where the curvature in this plane (toric radius $R_T$) corresponds to the distance from the source, and the curvature in the other plane is simply the Rowland circle.

In-depth Description of Imaging Process

Figure 11:
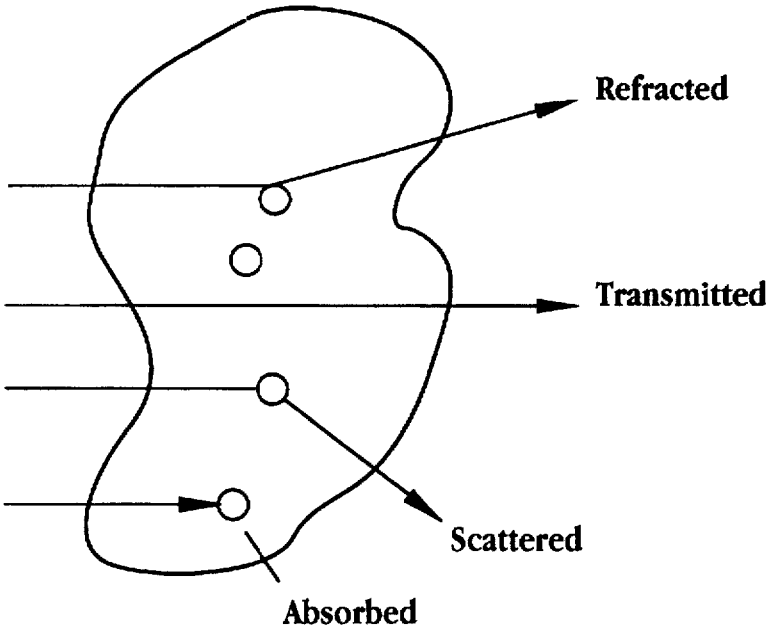
FIG. 11 is a view of a soft tissue specimen having the X-rays of this invention pass through the specimen at the interrogating interval illustrating specifically how refracted, scattered, and absorbed X-ray impart image information to the remain transmitted rays.

The imaging principle of this system is that any object placed in the beam between the two monochromator crystal arrays will cause some photons to be absorbed, scattered, and refracted as shown in FIG. 11. This should be distinguished from conventional X-ray imaging based only on photons being absorbed. This system images by virtue of all these processes as any angle change associated with scattering or refraction changes the Bragg angle on the second monochromator. The ray is then not Bragg reflected and does not reach the detector. Not only does this approach eliminate the blurring effect of Compton scattering in the object without the use of a grid, but actually allows imaging by virtue of the scattering phenomenon. Experimental data suggests that at cell/tissue boundaries refractive and scatter effects allow imaging of objects where density variation are negligible, i.e. tumors.

Figure 12:
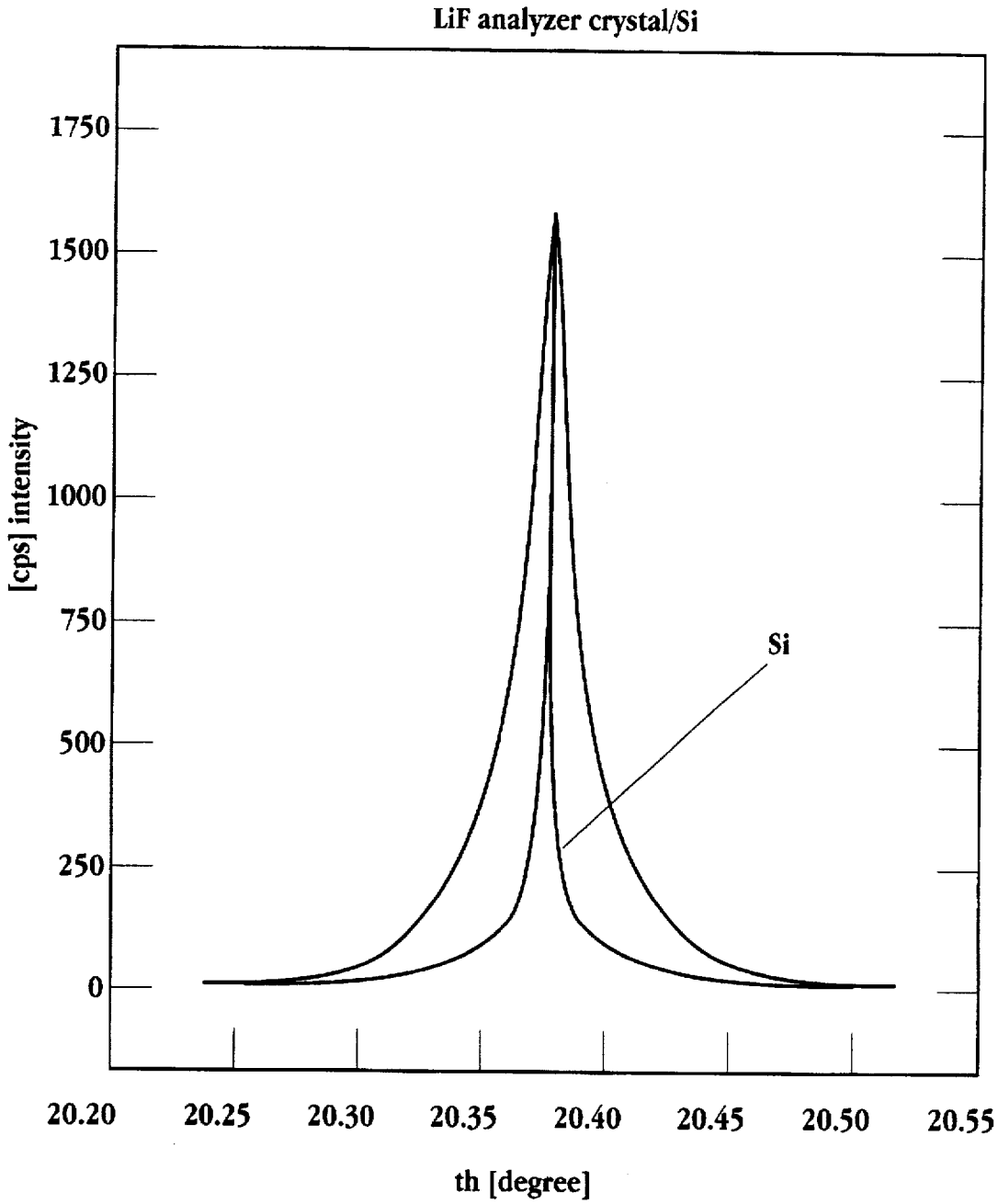
FIG. 12 illustrates the selectivity of various diffraction crystals that can be utilized with this invention.

The degree that the imaging system has sensitivity to refractive effects is directly related to the monochromator crystal material and its associated rocking curve width. Silicon for example has a 1.6 second rocking curve width, whereas lithium fluoride has one 60 times higher as shown in FIG. 12, partly by virtue of its mosaic crystal structure. Other materials that would commonly be considered are germanium, and quartz. The trade-off in higher refractive sensitivity with a narrower rocking curve width is overall image content, beam intensity, and fabrication tolerances.

The choice of crystal material also limits the energy that can be used, as the only lithium fluoride reflecting off of the 420 plane will allow a reasonably large Bragg angles at higher energies, i.e. 60 Kev.

In fact, depending on the dominant mechanism in the image detail of the object of interest, the ideal effective rocking curve may be larger than what is inherent the crystal of choice. In this case the analyzer crystal can be wobbled; over a larger range during the integration period of the detector, effecting a wider rocking curve.

The choice of X-ray energy allows the absorptive features to be minimized as compared to scatter or refractive. For mammography 17 KeV allows a balance in all imaging mechanisms, whereas 60 KeV would allow absorption features to be minimized.

The nature of the imperfections in the optics in this system require a normalization to be done to correct for variation in intensity in the field, particularly at crystal boundaries, where different Bragg reflection efficiencies would be very noticeable. This correction is less necessary in the time delay integration (TDI) approach either with film or digital, because of the sector shaped overlapping crystals and the averaging process inherent in TDI. In the case of image stitching/step scanning, intensity values must be normalized based on an image without an object. This can be done easily by the computer.

Detailed description of scanning and detection

Figure 19:
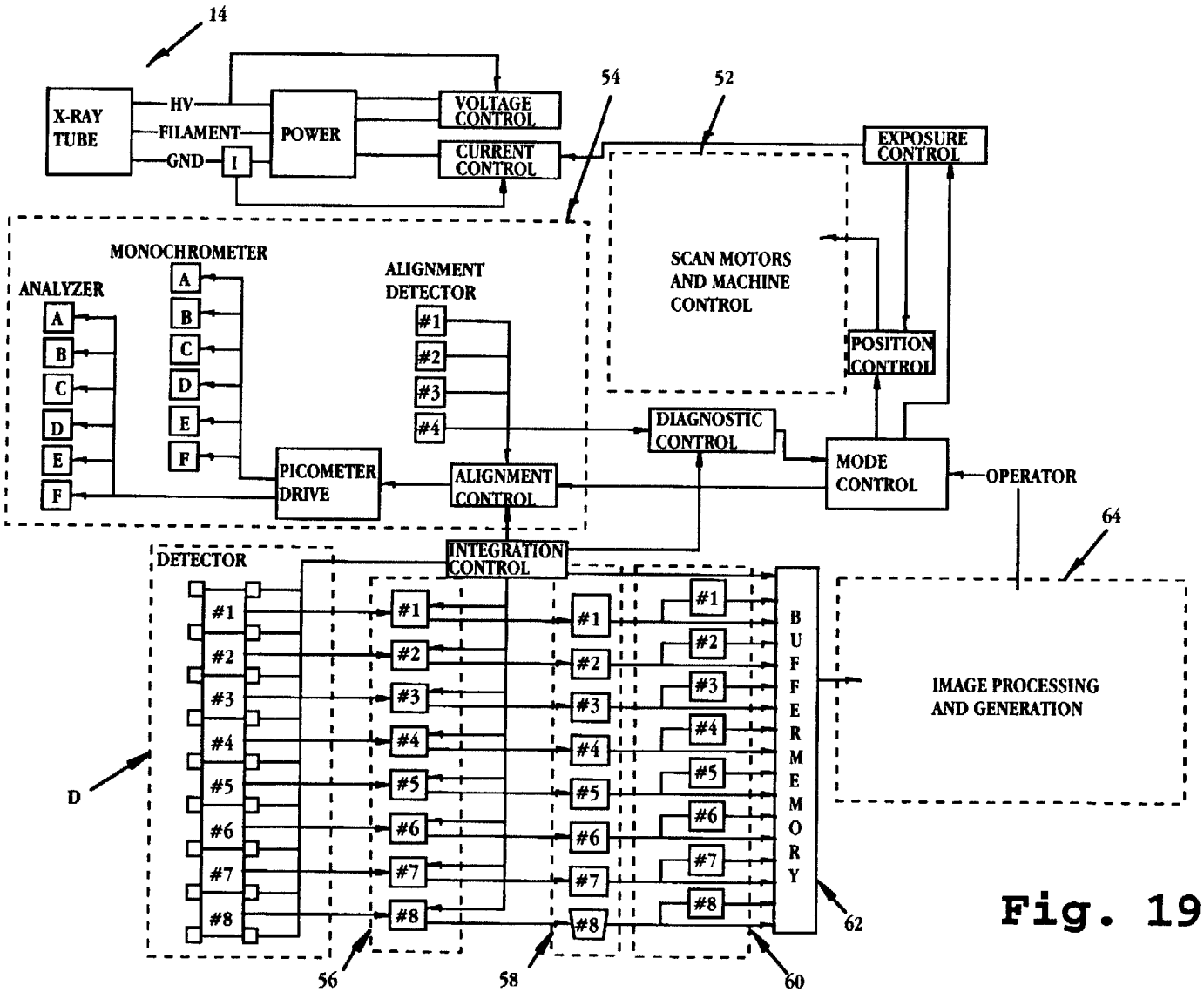
FIG. 19 is a block diagram of the image detection scheme of this invention.

The preferred embodiment for the detector is shown in FIG. 13A, 13B, and 19, which includes a prior art tiled array Scintillator\fiber-optic\CCD detectors, but so configured for specific unique benefits. This approach is enhanced for this application by using boundary photodiode intensity detector to establish an initial intensity measurement to enable the integration time for each of the 10 CCD modules/drivers to be established independently. In part, the CCD elements are sized to allow the data to be dumped within the time defined for the scan without readout noise dominating total noise. This embodiment will typically also have a dedicated DSP associated with each CCD array to facilitate rapid processing/deconvolution of the data in parallel.

The nature of the mammography application is such that the attenuation of X-rays in the patient range over several orders of magnitude depending on the location on the breast, particularly since skin line viewing is desired. The dynamic range of the CCD itself is limited to about 100, so in order to accommodate the attenuation and still have sufficient density resolution, the integration time for the CCD must be adjusted in a real time manner based on the highest intensity measured at the four corners of each CCD with these discreet photodiode detectors. In part, the CCD elements are sized so that a limited variation in intensity can be expected over the given area, again by virtue of patient cross section.

As discussed above, the detector segments are additionally sized so that it emulates toric radius $R_T$. In order to obtain geometric aberration free scans, the surface of detection must lie on the surface of a toroid defined by the distance to the source in one plane, and by the distance to the slit in the other plane. This second criteria is inherent in the rotational scan about the slit, as shown in FIG. 3.

Aberration free geometry insures that a time delay integration approach for continuous scanning, or a slice image stitch protocol for step scanning can be used with no image artifacts.

The sector shape of the crystals in the arrays allow for the full coverage of the field, even with a significant inactive boundary on the crystals as shown in FIG. 9, although intensity correction must be applied to the part of the image where the crystal boundary exists.

The linear scan process shown in FIG. 4 in a continuous scan mode with discrete pixel by pixel integration allows a three dimensional image to be deconvoluted. Although there are a variety of ways of deconvoluting in the prior art, the preferred approach is to view the situation as one of differential velocity, where features at different heights in the patient have different velocities in the image during a scan of constant mechanical velocity.

Figure 14:
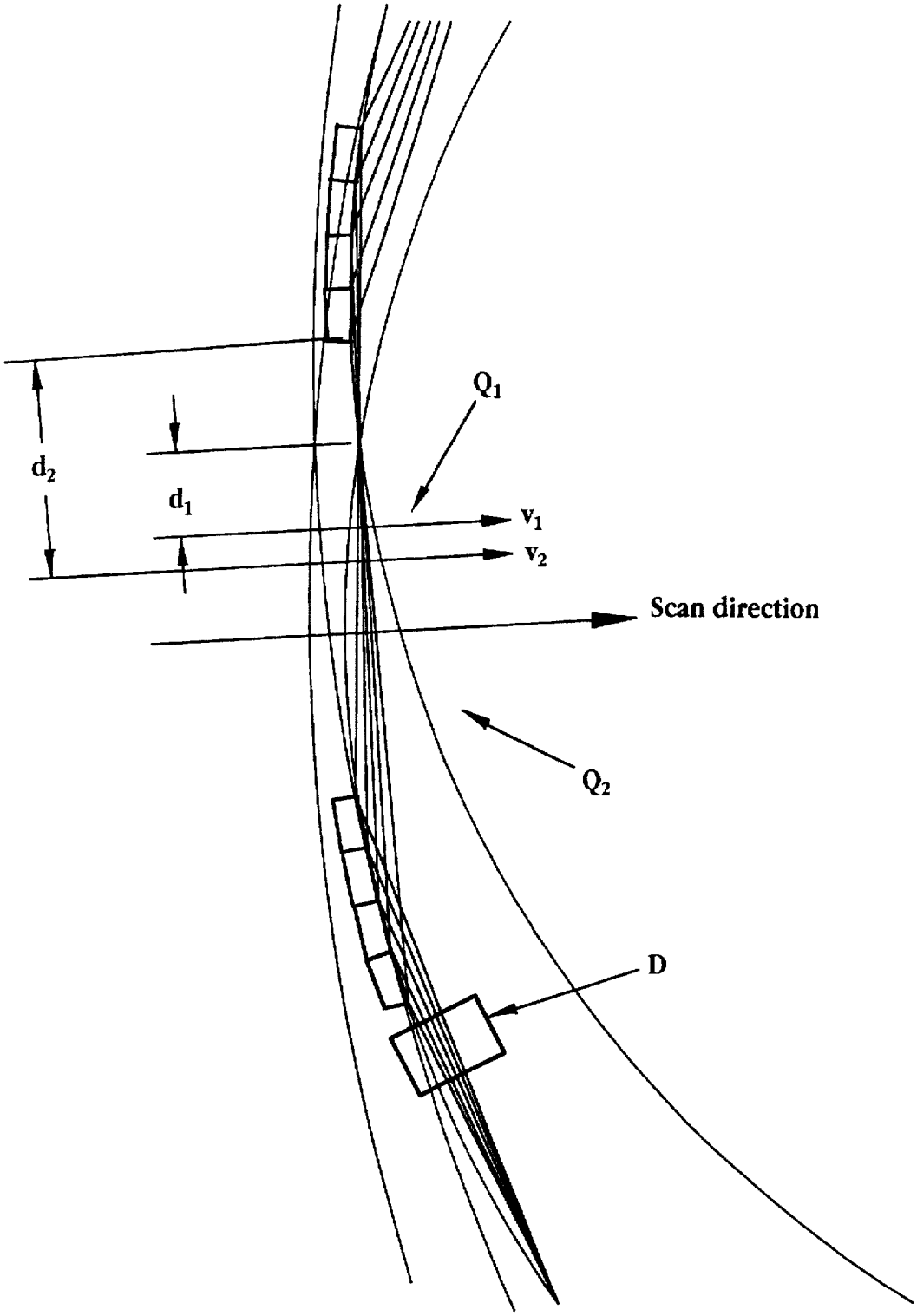
FIG. 14 is a schematic view of the scan of this invention illustrating how the apparent difference in scan velocity can be utilized to examine the scanned specimen in segments taken normal to the mean scan direction of the interrogating X-rays.

Because of the unique line source nature of the optics, the object can be located where significant differences in velocity exist between the top and bottom of the patient, effecting better deconvolution as shown in FIG. 14. As the object is moved closer to the line source (a), as compared to position (b), the beam becomes more narrow, in effect resulting in magnification of the image on tiled array ccd detectory D, increasing system resolution. There is no patient dose penalty for this magnification. Although the beam intensity is much higher near the line source, the time the patient is exposed is less as the system scans, as the beam is also narrower. It can be seen at distance $d_1$–a portion of specimen $Q_1$ closer to the source—has a smaller velocity $v_1$. It can be seen at distance $d_2$—a portion of the specimen $Q_2$ further from the source—has a larger velocity $v_2$. One embodiment of this deconvolution allows one to define a relevant number of depth slices in the patient, i.e. 10 to 50, and do a factor analysis/singular value decomposition, with the initial value at any depth being define by a conventional time delay integration based on the image velocity at that depth.

An added feature of three dimensional imaging done in this manner is that the quality of the data in a specific volume of interest is significantly enhanced. Not only is there no overlying image features that may obscure the image in the volume of interest, but noise factors fall out of the image by virtue of the SVD algorithm.

An additional enhancement to image quality and three dimensional imaging is the ability to magnify in one dimension the image to increase resolution without additional image degradation resulting from Compton scatter typical in magnification geometries on conventional systems.

In-depth Description of Crystal Fabrication Methods

The monochromators in this system are arrays for the purpose of facilitating their fabrication, both from the standpoint of yield and stress reduction, as will be described and for the purpose of optimizing each row separtely if necessary.

Figure 17B:
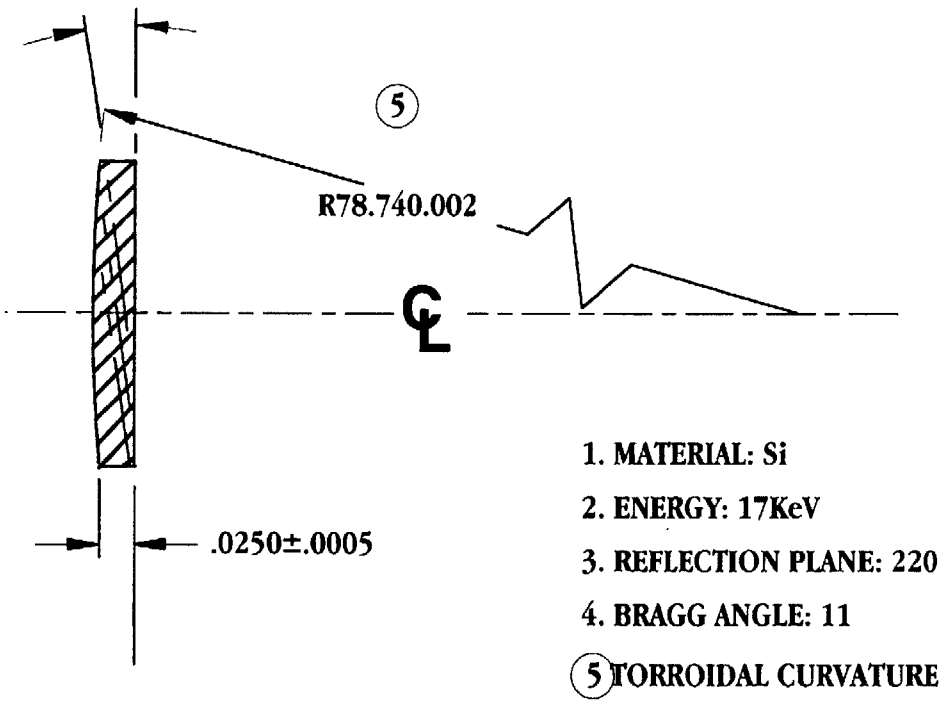
FIG. 17A and 17B illustrates a crystal segment utilized with this invention.
Figure 17A:
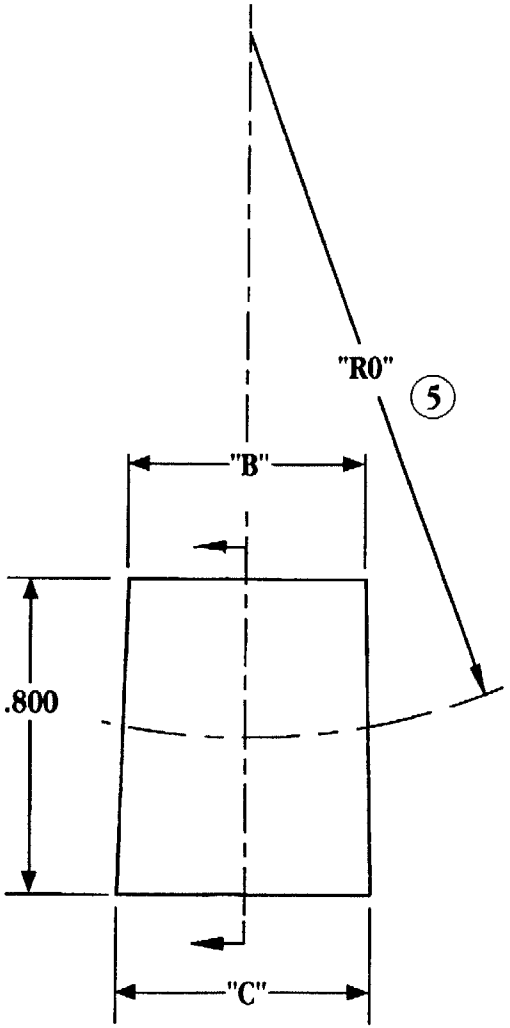

The design of these Johansson crystals is show in FIG. 17A and 17B, where crystal C is bonded to base B with either glue, a diffusion bond, or other bonding intermediate layer. It is necessary to match the thermal expansion coefficient between the base and the crystal so that the differential expansion does not distort the curvature. The preferred embodiment for silicon is to also make the base out of silicon, and anodically bond the two together with a sputtered glass interface. This method requires only moderate temperatures.

The physical tolerance for fabricating the crystals is exceeding tight, particularly when the final tolerances are a result of machining, bending, and bonding the crystal to the mount.

The method that has been discovered to provide the necessary tolerances in a toroidally curved and bent crystal is a triple diamond point lathe machining process, with an intermediate bonding process.

The unique aspect in particular to this approach is that a toroidal shape can be obtained with stresses in the crystal that are little higher than what would be typical of a cylindrically bent crystal. Stress in cylindrically bent crystals are by prior art demonstrated to be acceptable, even for silicon, both in fracture limit and degradation of reflectivity by virtue on crystal strain. Prior art in forming toroidal curvature has limited their use because of this problem.

Figure 15:
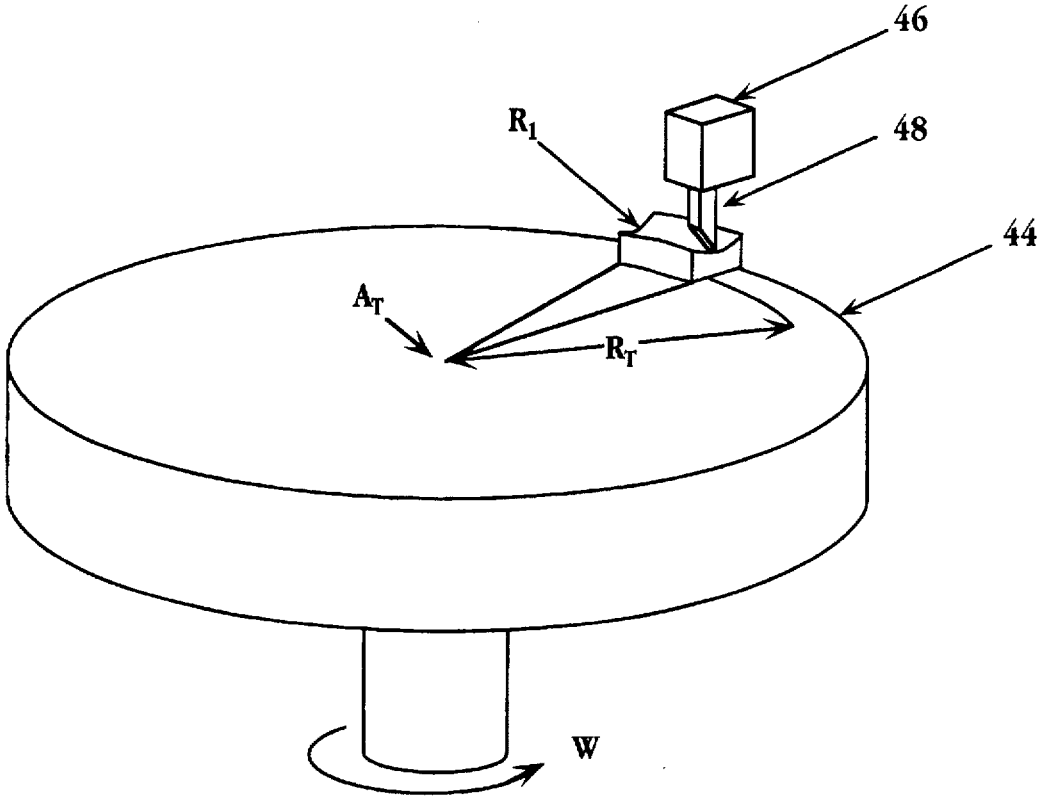
FIG. 15 illustrates a specialized lathe useful in producing the segmented diffracting surfaces utilized in this invention.
Figure 16C:
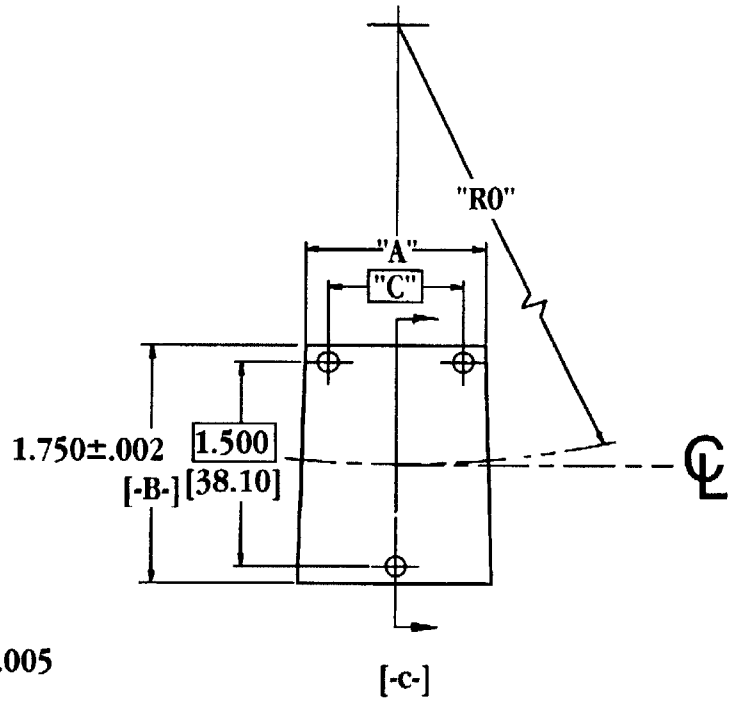
FIGS. 16A, 16B, and 16C illustrates respective side elevation, expanded detail, and plan of a mount for one of the crystal segments utilized herein.
Figure 16B:
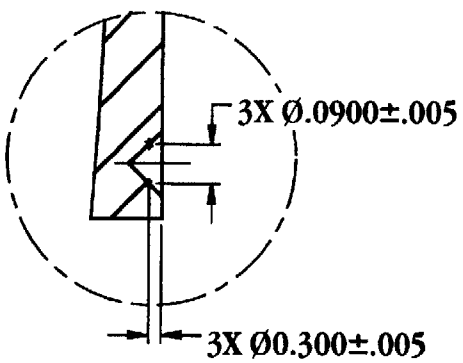
Figure 16A:
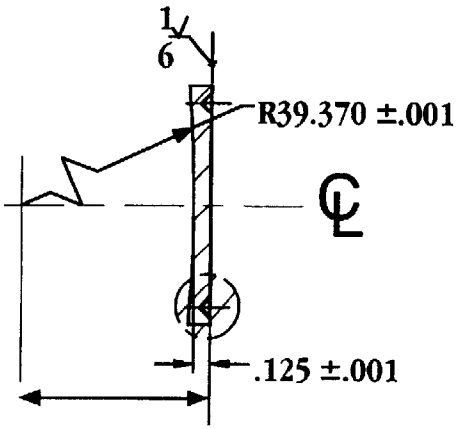

FIG. 15 shows the basic technique for cutting the toroid shape on a diamond turning lathe. The crystal is located at toric radius RT on turn table 44. Location is at an equivalent distance to the position the crystal with respect to the source in the X-ray system. The Rowland circle related diameter (diffraction radius $R_1$) is then cut by virtue of NC programming to control cutting head 46 and diamond tool 48. This process applies to the mount, the back of the crystal before mounting, and the front of the crystal after mounting, generating the shapes shown in FIGS. 16, 17, and 18.

Figure 18B:
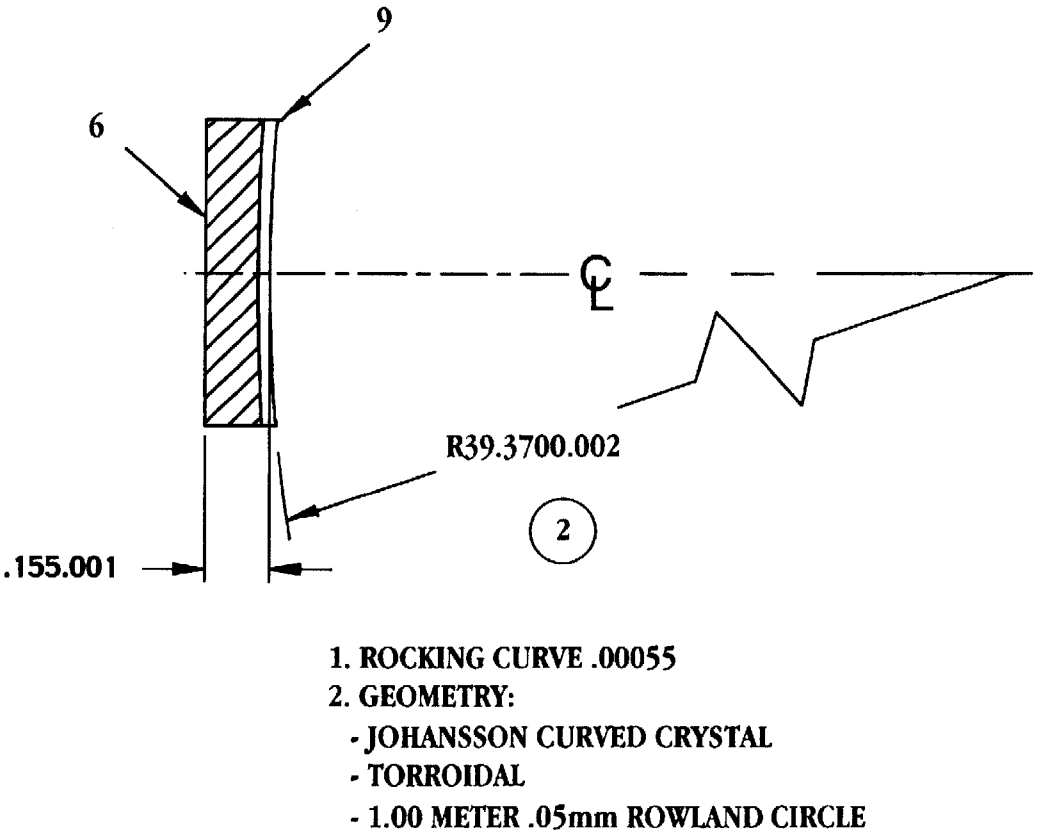
FIG. 18A and 18B illustrates the mount and crystal segment bonded together with the final finished surface place on the crystal structure within the mount.
Figure 18A:
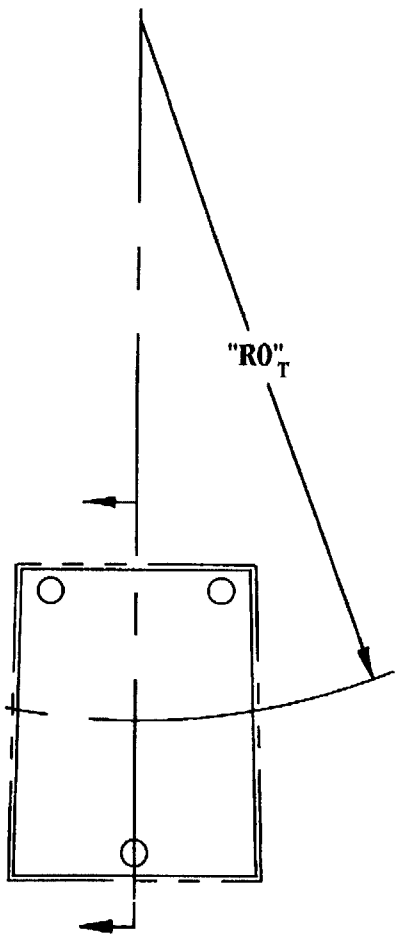

The resulting final assembly as shown in FIG. 18A and 18B has a crystal of constant thickness, and low residual stress, as the bonding of the convex toroidal shape of the back of the crystal (FIG. 17A and 17B) to the concaved toroidal mount (FIG. 16A, 16B, and 16C) induces minimum stress.

The parameters of crystal mount construction are as follows:

TABLE 2

FIG. 17A AND B

| P/N | "A" | "B" | "C" | LOCATION | "RO" 1.003 [0.76] |
|---|---|---|---|---|---|
| 10 - | 8 | 1 10 | 1.20 | MONOCROMATOR | 19.097 |
| 20001 | 250 | [27.9] | [30.5] | ROW 1 | [485.06] |
| 10 - | 10 | 1 20 | 1.30 | MONOCROMATOR | 20.857 |
| 20002 | 810 | [30.5] | [32.8] | ROW 2 | [529.77] |
| 10 - | 13 | 1 30 | 1.39 | MONOCROMATOR | 22.623 |
| 20003 | 370 | [32.8] | [35.3] | ROW 3 | [574.62] |
| 10 - | 15 | 1 39 | 1.48 | MONOCROMATOR | 24.390 |
| 20004 | 930 | [35.3] | [37.6] | ROW 4 | [619.50] |
| 10 - | −3 | 2 28 | 2.37 | ANALYZER ROW 1 | 41.066 |
| 20005 | 75 | [57.8] | [60.2] | | [1043.08] |
| 10 - | −1 | 2 37 | 2.46 | ANALYZER ROW 2 | 42.802 |
| 20006 | 190 | [60.2] | [62.5] | | [1087.17] |
| 10 - | 1 | 2 46 | 2.56 | ANALYZER ROW 3 | 44.522 |
| 20007 | 370 | [62.5] | [65.0] | | [1130.86] |
| 10 - | 3 | 3 56 | 2.66 | ANALYZER ROW 4 | 46.222 |
| 20008 | 930 | [65.0] | [67.6] | | [1174.04] |

The parameters of crystal construction are as follows:

TABLE 3

FIG. 16A B AND C

| P/N | "A" | "B" | "C" | "RO" |
|---|---|---|---|---|
| 11 - | 1 040 | 1,136 | 750 [19.05] | 19.097 [485.06] |
| 20001 | [26.42] | [28.85] | | |
| 11 - | 1 136 | 1,234 | 750 [19.05] | 20.857 [529.77] |
| 20002 | [28.65] | [31.34] | | |
| 11 - | 1 234 | 1,328 | 1,000 [25.40] | 22.623 [574.62] |
| 20003 | [31.34] | [33.75] | | |
| 11 - | 1 328 | 1,422 | 1,000 [25.40] | 24.390 [619.50] |
| 20004 | [33.75] | [36.12] | | |
| 11 - | 2 216 | 2,310 | 1,000 [25.40] | 41.066 |
| 20005 | [56.29] | [58.67] | | [1043.08] |
| 11 - | 2 310 | 2,404 | 1,000 [25.40] | 42.802 |
| 20006 | [58.67] | [61.06] | | [1087.17] |
| 11 - | 2 404 | 2,498 | 1,000 [25.40] | 44.522 |
| 20007 | [61.06] | [63.45] | | [1130.86] |
| 11 - | 2 498 | 2,592 | 1,000 [67.6] | 46.222 |
| 20008 | [63.45] | [65.84] | | [1174.04] |

The parameters of figure to the diffracting surface of the chips are as follows:

TABLE 4

FIG. 18B

| P/N | 1 CRYSTAL | 2 MOUNT | "T" |
|---|---|---|---|
| 12 - 20001 | 10 - 20001 | 11 - 20001 | 19.097 [485.06] |
| 12 - 20002 | 10 - 20002 | 11 - 20002 | 20.857 [529.77] |
| 12 - 20003 | 10 - 20003 | 11 - 20003 | 22.623 [574.62] |
| 12 - 20004 | 10 - 20004 | 11 - 20004 | 24.390 [619.50] |
| 12 - 20005 | 10 - 20005 | 11 - 20005 | 41.066 [1043.08] |
| 12 - 20006 | 10 - 20006 | 11 - 20006 | 42.802 [1087.17] |
| 12 - 20007 | 10 - 20007 | 11 - 20007 | 44.522 [1130.86] |
| 12 - 20008 | 10 - 20008 | 11 - 20008 | 46.222 [1174.04] |

In-depth Description of System Operation

Referring to FIG. 19, the sub-systems of the image processing can be described. X-ray tube 14 is shown with standard driving subsystems. Further, conventional scan and machine controls 52 provide both scan and platform positioning and conventional breast compression. Machine function is preprogrammed in alignment, position, and exposure controls 54. Tiled array ccd detector D is shown with output to conventional drivers 56. Thereafter, conversion at analog/digital converters 58 with output to digital signal processor (DSP) 60. Final output is to buffer memory 62 with a conventional computer processor image generating processing following in computer array 64.

Building upon the preceding subsystems descriptions, the overall system functionality is represented in FIG. 19.

Upon power-up, the instrument executes a diagnostic and alignment routine to insure proper operation. FIG. 20 shows the steps in this process. Five degrees of freedom on the monochromator platform, four degrees on the analyzer and three degrees on the slit are adjusted. The algorithms uniquely combined several degrees of freedom at one time to effect independent control of the Bragg reflection, k alpha line centering, longitudinal field symmetry, left lateral field symmetry, and right field lateral symmetry. Six intensity detectors in both the patient plane and the detector plane are use to detect the field intensities for both the monochromator and analyzer adjustment.

After passing alignment standards, the four alignment detectors and the discrete boundary detectors in the CCD array remain working as diagnostic monitors to insure safety and performance. Any fault results in shut down of the system.

Before an exposure, the operator defines the following parameters:

Field size
Field position
Compression force
Scan type
Step scan
TDI scan
Three dimensional scan
Real time
Compression command
Exposure command During an exposure, control commands either a high pulsed X-ray tube current for a step scan, or a medium constant current for a TDI scan. In either case the current is defined by the maximum heat load limit of the X-ray tube. In the case of the step scan, the pulse duration is based on the lowest measured intensity of the boundary detectors that results in more than the minimum number of photon counts with the largest integration period, i.e. 200 ms. After exposure, the system then has 300 ms to transfer the data, and simultaneously move to the next position.

In the case of the TDI or 3D scan, the mechanical scan rate is adjusted based on the lowest boundary intensity detector. The X-ray tube is operating at a constant current that is the maximum allowed for a period to complete the entire scan, i.e. 2 to 3 seconds.

Both for a constant rate scan or a step scan, prior art PDI algorithms can be used to control the motors for rapid, smooth, accurate positioning with no overshoot or droop.

Alternate Embodiments and Applications

One possible embodiment is to incorporate a two dimensional focusing embodiment with a monochromatic point source.

Figure 21:
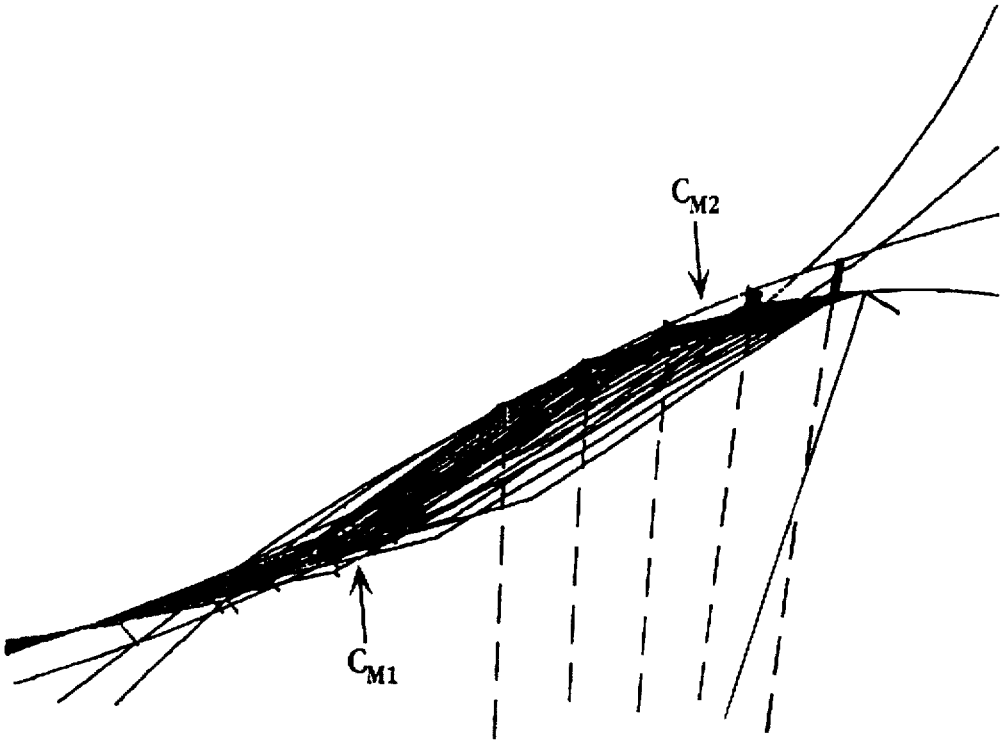
FIG. 21 illustrates a crystal array doublet.
Figure 26:
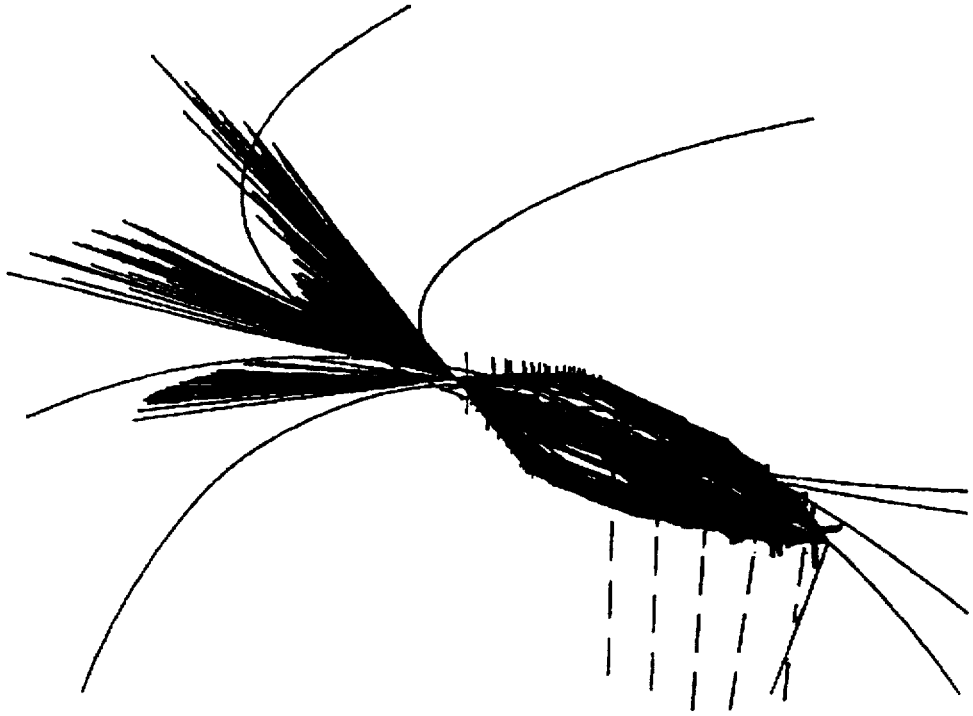

FIG. 21 shows a two dimensional implementation of focusing. This approach using two toroidally curved monochromators at 90 degrees (crystal monochromator array $C_{M1}$ and crystal monochromator array $C_{M2}$ [to avoid confusion, actual drawing of the crystals has been omitted]) allows the focusing of all rays Bragg reflecting at the same energy to be focused to point source $S_1$, rather than the previously illustrated slit aperture stop S. A similar configuration can be used for the analyzer. The benefits of this two dimensional focusing embodiment are for a true X-ray microscope with the same imaging capability inherent in the technique, and for real time imaging systems, i.e. fluoroscopy where scanning in one dimension is contrary to the real time concept. A dramatic dose reduction would be associated with a monochromatic point source for fluoroscopy.

Figure 22A:
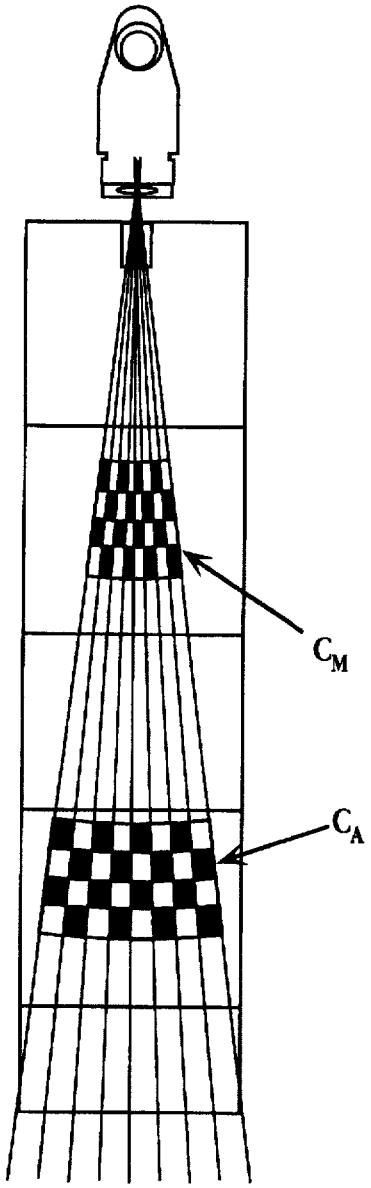
FIG. 22A and 22B are schematics useful in understanding the scan protocol of this invention.
Figure 22B:
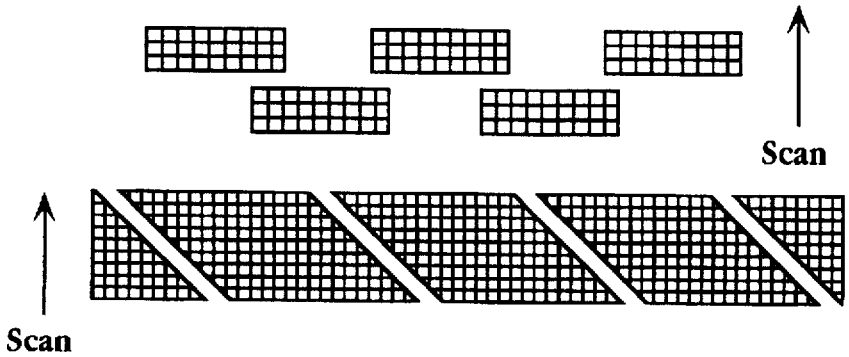

An alternate embodiment of a staggered array is shown in FIGS. 22A and 22B. These figures show respectively a plan view schmatic and a schematic in the direction of scan. This demonstrates how a staggered array of high aspect ratio multi-line detectors (not unlike that shown in some prior art embodiment) used in conjunction with slot scanning and TDI data acquisition techniques. (It is noted that the presence of crystal monochromator array $C_M$ and analyzer crystal array $C_A$ distinguish this from the prior art.) It is to be noted, that analyzer crystal array $C_A$ and crystal monochromator array $C_M$ can have a staggered construction just as the known and illustrated detectors in FIG. 22B have a staggered construction. Information that is "lost" in any one image will be acquired during total scan of the instrument.

The benefit of this approach is a much lower cost system, but it is dependent on sufficient intensity to maintain low exposure times with a small field of detection. The lower cost is associated with facilitating fabrication of the semiconductor elements, particularly for direct conversion approaches. The diffraction crystals can similarly be made partial Staggered arrays with a significant cost reduction for these components.

Figure 23A:
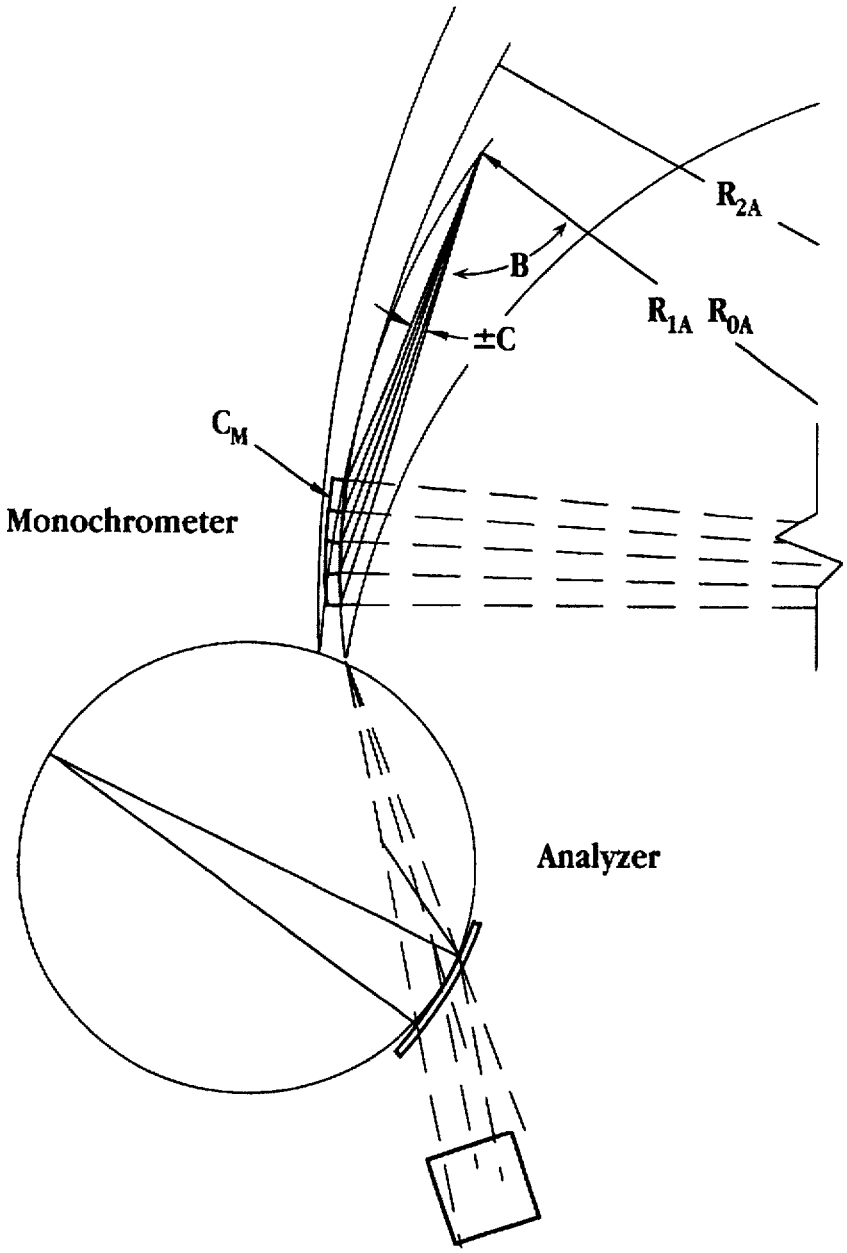
FIG. 23A and 23B are respective schematics useful in explaining the scan format of this invention.
Figure 23B:
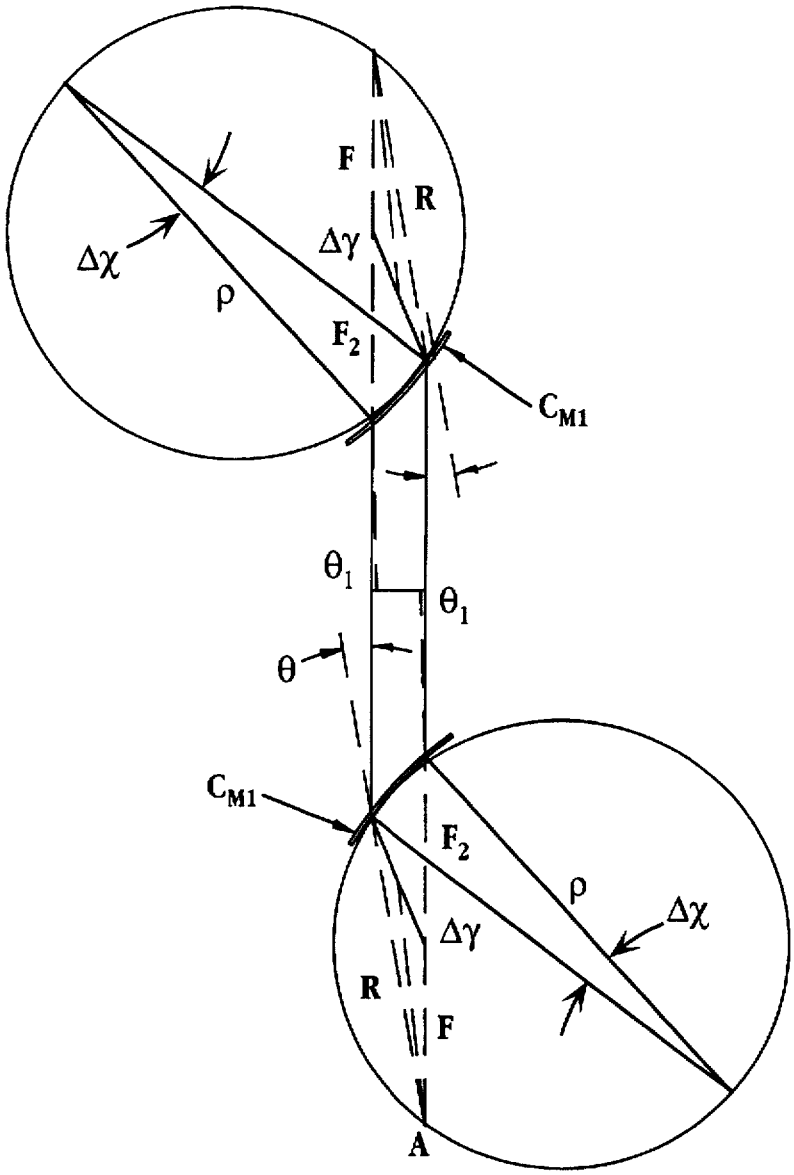

With reference to FIGS. 23A and 23B, a transmission analyzer crystal $C_{A1}$ is illustrated.

The preferred embodiment uses a Bragg reflection analyzer (analyzer crystal array $C_A$) and monochromator (crystal monochromator array $C_M$) . A curved Laue transmission crystal of prior art design has been used as a monochromator before the patient, without the use of an analyzer. In fact, such a curved Laue transmission monochromator $C_{M1}$ can be used for the analyzer as shown in FIG. 23A, or both the analyzer $C_{A1}$ and monochromator $C_{M1}$, as shown in FIG. 24, to achieve the same imaging mechanisms as described in the preferred embodiment.

Figure 24:
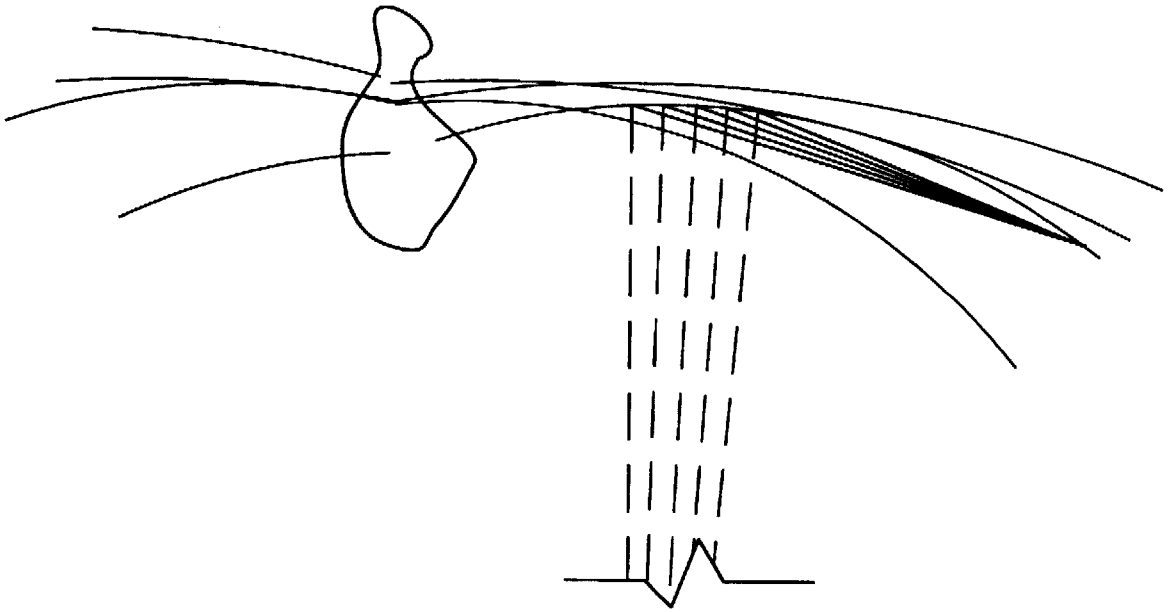
FIG. 24 is a schematic illustrating the off axis utilization of this technique where X-rays to the analyzer crystal array are not co-linear with X-rays from the crystal monochromator array.

An off axis scattering configuration can be seen with respect to FIG. 24.

As the primary imaging mode in some situations may be scattering, the orientation of the analyzer beam direction may be significantly off the axis of the monochromator beam as shown in FIG. 24, and form a higher contrast image by virtue of detecting scattered radiation, rather than be virtue of detecting the unscattered beam with reduced intensities where scatter is present.

Figure 25:
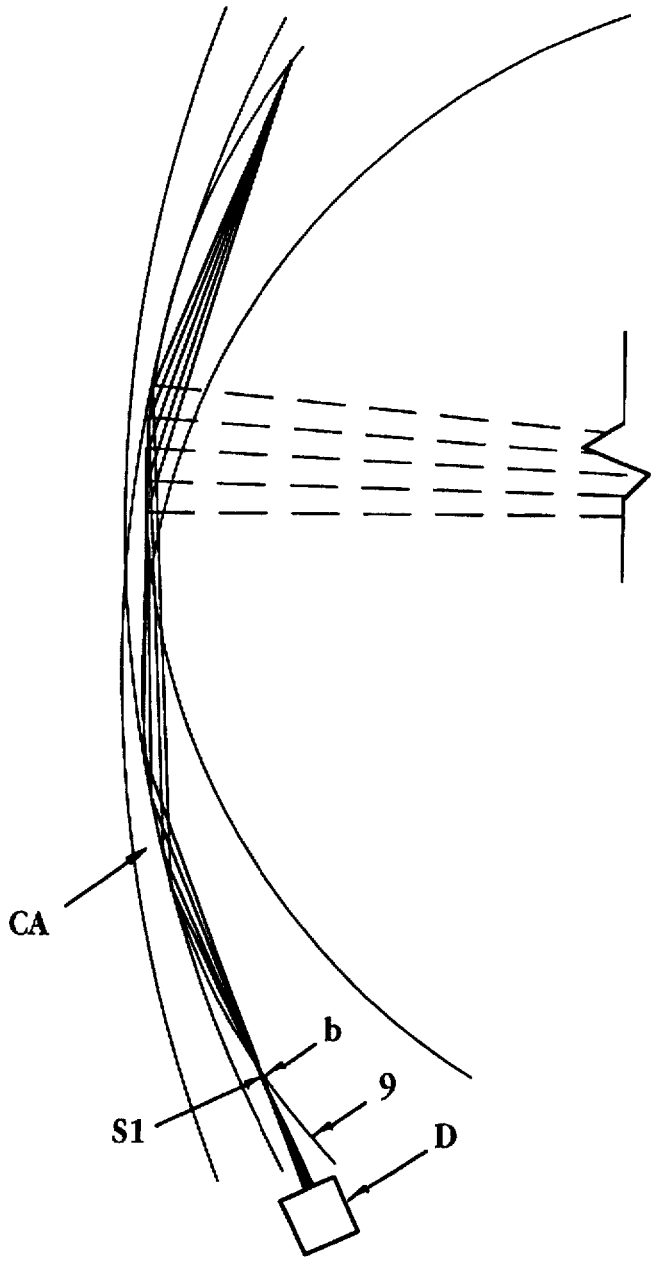
FIG. 25 is a scan schematic of an alternate embodiment of this invention; and, FIG. 26 illustrates an array of diffraction doublets and the ray traces generated by the doublets imparting an improved resolution to the generated images.

A secondary scatter slit is illustrated in FIG. 25.

To further shield the detector from all radiation scattered by the analyzer, tiled array ccd detectory D can be located down stream from additional slit aperture stop $S_1$, located at the focal point of the analyzer crystal array $C_A$, as shown in FIG. 25. In some applications this additional slit may improve image quality, depending on the dominant imaging mechanisms.

Alternately, TDI modification for eliminating curvature can be utilized. As an alternative to curvature of the detector in the plane normal to the scan direction as shown in FIG. 13A and 13B, the TDI integration times can be modified along the length of the detector based on the difference in distance from the source, and the corresponding difference in image velocity during the scan.

It will be realized that this disclosure includes considerable oncology potential. To accompany the ability to detect microtumors less than one millimeter in size, X-ray diffraction optics allow an array of orthogonal doublets as described above to focus X-rays for therapeutic purposes with a dose to a one millimeter tumor at a 4 cm depth on the order of 100 times higher than any surrounding tissue. To understand a single doublet, the reader is reminded that this construction has been previously set forth in FIG. 21. FIG. 27A illustrates the ray trace of four such doublets.

A combined system could encompass an imaging system and a therapeutic system that operate simultaneously, as they could operate at different wavelengths and not interfere.

What is claimed is:

1. In a diffractive X-ray technique including, a broad band X-ray source;

a first X-ray monochrometer crystal surface for receiving the broad band X-rays and diffracting a monochromatic band of X-rays to a specimen;

an interrogation interval for receiving the specimen and imparting to the X-rays image information by absorption, critical angle scattering, and/or, refraction;

a second detection X-ray monochrometer crystal surface for revealing the image information by absorption, critical angle scattering, and/or, refraction to pass the monochromatic beam without the absorption, critical angle scattering, and/or, refraction X-rays; and, a transducing detector for imaging the monochromatic image bearing X-rays, the improvement comprising:

at least one of the monchronometer crystal surface comprising a plurality of segmented monochronometer crystals;

each segmented monochronometer crystal having a surface shape which imparts to the segmented monochronometer crystal a portion of a diffracting shape;

the plurality of segmented monochronometer crystals together forming a shape for receiving X-rays and diffracting the X-rays in a pattern from which image information can be derived.

2. In a diffractive X-ray technique according to claim 1 and further including:

one of the monchronometer crystal surfaces comprises a toric surface.

3. In a diffractive X-ray technique according to claim 1 and further including:

both of the monchronometer crystal surfaces comprise toric surfaces.

4. In a diffractive X-ray technique according to claim 1 and further including:

each segmented monochronometer crystal includes a mount deflecting the crystal to imparts to the surface shape of the monochronometer crystal at least a part of the surface shape of the crystal.

5. In a diffractive X-ray technique including, a broad band X-ray emitted from a point source;

a first X-ray monochrometer crystal surface for receiving the broad band X-rays and diffracting a monochromatic band of X-rays to a specimen;

an interrogation interval for receiving the specimen and imparting to the X-rays image information by absorption, critical angle scattering, and/or, refraction;

a second detection X-ray monochrometer crystal surface for revealing the image information by absorption, critical angle scattering, and/or, refraction to pass the monochromatic beam without the absorption, critical angle scattering, and/or, refraction X-rays; and, a transducing detector for imaging the monochromatic image bearing X-rays, the improvement comprising:

the first X-ray monochrometer crystal surface for receiving the broad band X-rays and diffracting a monochromatic band of X-rays to a specimen includes a toric surface for receiving broad band X-rays emitted from the point source and diffracting the X-rays to a line aperture;

an X-ray stop about the line aperture for passing X-rays at the line aperture and blocking all other X-rays; and, an expanding bundle of X-rays from the line aperture to the interrogation interval.

6. In a diffractive X-ray technique according to claim 5 and further including:

means for scanning the expanding bundle of X-rays from the line aperture across the interrogation interval.

7. In a diffractive X-ray technique according to claim 5 and further including:

the transducing detector for imaging the monochromatic image bearing X-rays includes means for apparent differential velocities of observed image features to be segregated by apparent scan velocity.

* * * * *